US008337263B2

(12) United States Patent
Freakes

(10) Patent No.: US 8,337,263 B2
(45) Date of Patent: Dec. 25, 2012

(54) INSULATION DISPLACEMENT CONNECTOR

(76) Inventor: Anthony Freakes, Skillman, NJ (US)

( * ) Notice: Subject to any disclaimer, the term of this patent is extended or adjusted under 35 U.S.C. 154(b) by 0 days.

(21) Appl. No.: 13/213,144

(22) Filed: Aug. 19, 2011

(65) Prior Publication Data

US 2011/0306232 A1 Dec. 15, 2011

Related U.S. Application Data

(62) Division of application No. 12/609,904, filed on Oct. 30, 2009, now Pat. No. 8,025,522.

(60) Provisional application No. 61/110,090, filed on Oct. 31, 2008.

(51) Int. Cl.
*H01R 7/18* (2006.01)

(52) U.S. Cl. ..... 439/877; 439/403; 439/396

(58) Field of Classification Search ..... 439/877, 439/403, 396

See application file for complete search history.

(56) References Cited

U.S. PATENT DOCUMENTS 3,861,780 A * 1/1975 Hobbs, II ..... 439/877
3,924,917 A * 12/1975 Munshower ..... 439/422
4,909,754 A * 3/1990 Paradis ..... 439/405
5,064,382 A * 11/1991 Minnis ..... 439/395
5,103,068 A * 4/1992 Schrader ..... 174/94 R
5,558,311 A 9/1996 Connolly et al.
5,588,859 A * 12/1996 Maurice ..... 439/290
5,944,551 A 8/1999 Kline et al.
6,010,362 A * 1/2000 Caviness et al. ..... 439/567
6,991,488 B2 1/2006 Freakes
7,204,136 B2 4/2007 Thrush et al.
2002/0098745 A1* 7/2002 Triantopoulos et al. ..... 439/877
2004/0132330 A1* 7/2004 Bonvallat et al. ..... 439/403
2005/0219139 A1 10/2005 Kimura et al.
2007/0294873 A1* 12/2007 Bogursky et al. ..... 29/34 D

* cited by examiner

*Primary Examiner* — Gary F. Paumen

(74) *Attorney, Agent, or Firm* — Timothy X. Gibson, Esq.; Gibson & Dernier LLP

(57) ABSTRACT

An insulation displacement connector having two deformable tangs forming a receiving pocket in which a wire may be placed, the deformable tangs adapted to be curled around the wire to create a secure connection that is resistant to disconnection by movement. Also disclosed is a method for creating the secure connection. A solenoid assembly that employs the disclosed insulation displacement connector that reduces the risk of a disconnection is also described. Also disclosed is a device that secures wires to the disclosed insulation displacement connector.

16 Claims, 31 Drawing Sheets

INSULATION DISPLACEMENT CONNECTOR

APPLICATION DATA

This application is a divisional application of U.S. patent application Ser. No. 12/609,904 filed Oct. 30, 2009 which claims benefit to U.S. Provisional Application No. 61/110,090 filed on Oct. 31, 2008, each of which are incorporated by reference herein in their entireties.

TECHNICAL FIELD

The present invention is directed to methods and apparatus for using insulation displacement connectors to establish a secure electrical connection to one or more wires.

BACKGROUND OF THE INVENTION

A conventional connector in the solenoid context provides a connection from a pair of insulated lead wires to the insulated magnet wire of the solenoid coil. This connection is made by having the conventional connector provide a mechanism for penetrating and displacing the insulation of each lead wire and making respective electrical connections between the magnet wire and the lead wire. The conventional connector includes a conductive element, which is electrically connected to the magnet wire of the solenoid. Typically, the conductive element is sized and shaped to essentially cut or bite into the insulation, and contact the conductor, of the lead wire as the lead wire is pressed into the conventional connector. Once the conventional connector has established a connection to the lead wire, it is best not to disturb its position in any way that would disrupt the position of the magnet wire or the lead wire. There are many environments where the connection of the conventional connector is lost because some external force disturbs and moves the conventional connector. The conventional connector may employ a staple to lock the lead wire in place in an effort to avoid loss of electrical connection. However, placement and deployment of the staple can be troublesome and may cause the very disturbance that the staple is supposed to prevent, i.e., due to the force the staple applies to the lead wire.

Typically, the orientation of the conventional connector in the solenoid context is such that the conventional connector is set in a bobbin that forms part of one end of the solenoid coil. The bobbin and conventional connector are located at the end of the solenoid closest to where the lead wire enters the solenoid assembly. This serves two purposes, one being the lower cost by requiring less lead wire length, and the second being the reduction in risk of short circuiting due to the lead wire contacting the magnet wire of the solenoid coil. However, the foregoing orientation is disadvantageous because the connection between the conventional connector and lead wire is susceptible to external disturbances as the connection point is situated close to the lead wire entry point.

The current use of a connector described in U.S. Pat. No. 6,991,488 is directed to insulation displacement techniques of penetrating an insulation jacket and making contact with the internal conductors. A drawback of such insulation displacement techniques, along with soldering techniques, is that the contact is hidden from normal visual examination. This means that usual inspection of the contact is done by measuring the continuity by instruments which are simply connected to the circuit. Although this method can certainly detect open and most bad contacts, it can miss some faulty contacts that will not be sustainable during field use. This is because a meter can only read what is happening at the moment it is being used to make a measurement. The meter cannot predict what will happen in the future nor can it tell if an even slight external jiggle of the wire causes an unreliable intermittent contact.

A good predictor of contact reliability is a visual comparison with what has been proved to be reliable. A skilled artisan, upon visual inspection, would readily recognize a contact which may prove to be bad in the future even though it could pass an immediate meter test.

Another disadvantage of penetrating insulation to make contact with internal conductors is that the insulation compresses into the space between the contact arms, restraining the spring-loaded arm pressure which is desirable for good contact.

A conventional approach to addressing the potential loss of connection is to attach a crimped brass clip to a stripped end of the lead wire. The crimped brass clip may be attached to both the end of the lead wire and an inner starting end of the magnet wire of the coil. The crimped brass clip acts as a key when encapsulating plastic material flows and sets rigidly around the components (including the lead wire) of the solenoid. Although this serves to provide resistance to most external forces, it does not prevent small disturbances to the connection zones which can cause an opening of the connection, such as during thermal cycling or other situations.

Moreover, the crimped brass clip presents a danger of shorting the magnet wire of the coil. A short circuit can occur if the crimped brass clip is located over the outer turns of the coil as extreme heat, pressure, and/or the spurting turbulence of the encapsulating plastic enters and surrounds the coil. Under these conditions, the brass clip may be propelled violently against the outer turns of the magnet wire of the coil and may penetrate the magnet wire insulation. To mitigate this problem, the conventional approach is to provide protective insulating tape over the coil. The theory is that the tape prevents both the short circuit and a stripping of the magnet wire insulation by the extreme heat of the encapsulating plastic. Three thicknesses of 0.007 inch tape has been accepted in the art to be sufficient to protect against short circuits, while one thickness of 0.007 inch tape has been accepted to protect against the melting (stripping) of the magnet wire insulation.

Notwithstanding the above, there is still a potential that the insulating tape will not prevent a short circuit with the lead wire. Further, as the cost of the insulating tape and the installation efforts of same are significant elements of the overall cost of solenoid assembly, there is interest is reducing the amount of tape used. If the probability of shorting is significantly reduced or eliminated, then a significant cost saving is possible by using less (or no) insulating tape.

Maintaining the connection between the lead wire and magnet wire is important for effective operation of the typical solenoid assembly, encapsulated solenoid or any other device where connectors are applied. A loose or completely disconnected lead wire is a common occurrence in a typical solenoid assembly. The current conventional approaches are prone to disconnection due to external forces and disturbances, increase the chance of short circuiting the solenoid coil, and can be costly to manufacture.

Through experimentation, it has been discovered that waggling of the strand of conductor wire as close to the electrical connector as 7.5 mm may cause longitudinal movement up to or more than 0.040" within the insulation, relative to the insulation and the connector. Such movement is considered a severe disturbance and may lead to disconnection of the electrical connection. When a portion of lead wire that is external to the encapsulation is severely bent, the conductor wires move longitudinally relative to each other and the insulation of the lead wire. This movement is transmitted along the lead wire for a certain length until there is sufficient frictional resistance and distortion of the strands to absorb the movement. If the electrical connection between the electrical connector and lead wire is within this distance, the electrical connection will be disturbed when the lead wire is bent and risk disconnection.

Therefore, there is a need in the art for a mechanism for maintaining a tight and robust connection between the lead wire and magnet wire by connectors.

SUMMARY OF THE INVENTION

It is an object of the present invention to provide an improved insulation displacement connector that establishes a secure electrical connection between the connector and at least one wire that is resistant to disconnection from external forces and disturbances. The improved insulation displacement connector may be part of a solenoid assembly, such as an encapsulated solenoid coil or any other device where connectors are used.

The present invention provides an insulation displacement connector and method for connecting one or more wires together electrically. A connector of the present invention may include a first end having deformable tangs and a receiving pocket for receiving a wire, a body, a second end and a fastener for receiving an additional wire. The connector may further include posts. The fastener may be disposed at the first or second end of the connector.

In one embodiment a receiving pocket may be formed by the tangs and sized and shaped to receive a wire therein. Once the pocket has received a wire, the tangs may be curled or crimped around the wire to create a secure connection that is resistant to external forces and disturbances. Such curling or crimping significantly improves the resistance to inadvertent disconnection of one or more of the wires connected to the connector. Producing such a robust electrical connection provides a substantial cost reduction by minimizing and possibly eliminating repair or replacement of disconnected electrical connections.

It is contemplated that the tangs may be curled or crimped around a wire where the insulation of the wire has been cut away or forced apart to expose an underlying strand of conductor wires. In this way the conductor wires are securely held in place and the connection is resistant to external disturbances such as pulling or bending of a free end of the lead wire.

The fastener may be any suitable fastening device operable to receive a wire. Preferably, the fastener is a slot or a post. When the fastener is a slot, the slot may be formed in the second end of the connector and configured to connect various wires, for example magnet wire to magnet wire, lead wire to lead wire, component lead to magnet wire, component lead to lead wire or other combinations known to the skilled artisan. In one embodiment the slot may include specific blade and cavity configurations that allow for the displacement of insulating material from a connected wire, to provide an effective, gas-tight mechanical and electrical connection, prevent inadvertent wire removal and prevent distortion of the connector. The effective, gas-tight mechanical and electrical connection may also be spring loaded and may allow the slot to accept wire of smaller diameter than has been heretofore economically practicable.

In an embodiment wherein the fastener is a post, the post may be an elongated post disposed on the first end and extending away from the body of the connector. The elongated post may be sized and shaped such that a portion of the elongated post may be wrapped by a wire and in one embodiment, be constructed to be bent at an angle suitable to prevent breakage and/or disconnection of the wire and reduce the likelihood of short circuits.

In one or more embodiments it is contemplated that the body, deformable tangs, posts and slots may be modified in size and/or shape to suit a particular need. The slots, body and/or posts may be modified to include one or more detents, protrusions, hooks, edges, wedges, blades, folds, ends or other modifications, to aid in fastening the connector to a corresponding mounting medium such as a receiving slot of a solenoid.

It is contemplated that a method for connecting one or more wires together electrically by the connector includes but is not limited to placing a wire in the receiving pocket of the deformable tangs, and curling the deformable tangs around the wire such that a tight and secure electrical connection is made that is resistant to external forces and movement. An insulating layer of the wire may be cut, pushed away and/or removed so that the deformable tangs are in direct contact with one or more conductive wires of the wire. The method may also include a step of placing a wire in the slot, if available, and creating a secure connection between the wire and slot. The method may also include a step of inserting the connector into a receiving slot of a bobbin, prior to placing a wire in the receiving pocket of the connector.

It is a further object of the present invention to provide an improved insulation displacement connector as part of a solenoid assembly with improved resistance to both disturbance to the electrical connection and slippage of wire insulation. In one embodiment an improved orientation of the wire is provided wherein the improved insulation displacement connector and mounting medium are situated away from the exit end of the lead wire. Such a solenoid assembly may include, but is not limited to a solenoid coil of magnet wire, a bobbin, a mounting medium, at least one insulation displacement connector, wherein the assembled parts may be encapsulated.

In another embodiment the solenoid assembly may be encapsulated to provide support and further aid in resisting disconnection from external forces and disturbances. The encapsulation material may include but is not limited to plastic, latex, silicone, rubber, glass or other suitable material as is known in the art.

In another embodiment the solenoid assembly may further include one or more crimp clips that may be attached to one or more wires and function to further aid in resisting disconnection from external forces and disturbances. The crimp clips may be located at various positions along the length of the wire that is encapsulated in the solenoid assembly.

Alternatively or additionally, the wire(s) may include one or more kinks along its length that is encapsulated in the solenoid assembly. When the encapsulation is formed around the kink(s), such encapsulation provides considerable resistance to even abusive attempts to pull out the insulation, and also provides isolation of the contact against external wire distortion produced disturbances.

Alternatively or additionally, the wire(s) may be embossed at one or more positions along the length of the wire(s). When the embossed portions are encapsulated, such encapsulation provides enhanced resistance to disconnection.

Alternatively or additionally, the wire(s) may include one or more tight 180 degree U-turn configurations in the length of wire. When the tight U-turn configurations are encapsulated, enhanced resistance to disconnection is provided.

Alternatively or additionally, the wire(s) may include one or more tight 360 degree loop configurations in the length of wire that may be encapsulated in the solenoid assembly.

When the tight 360 degree loop configurations are encapsulated, such encapsulation provides enhanced resistance to disconnection.

In another embodiment, the wire(s) may include one or more loose U-loop configurations in the length of wire that may be encapsulated in the solenoid assembly. When the loose U-loop configurations are encapsulated, such encapsulation provides enhanced resistance to disconnection.

It is another object of the present invention to provide a device for creating a secure electrical connection between an electrical connector and at least one wire such that the electrical connection is resistant to disconnection from external forces and disturbances. It is contemplated that the electrical connection may be made by curling and crimping the tangs of the electrical connector around the wire.

In one embodiment the device may include a work station having a stop guide rocker, crimping tools, and a motorized mechanism or other mechanism as is known in the art. The device may also include one or more spring-loaded sheaths, work-piece holders, wire guides, a work-piece slide, and/or an escapement mechanism. The device is adapted to receive various shaped work-pieces, such as a solenoid coil.

The work-piece slide may function to hold a plurality of work-pieces. When the device also includes an escapement mechanism, the escapement mechanism functions to release the completed work-piece, and the next work-piece in the slide may drop into the work station.

In another embodiment, the device may include at least two crimping tools that function to crimp two separate connectors positioned on the bobbin of the solenoid assembly. In this embodiment, the crimping tools may be connected to a cam shaft that functions to move the crimping tools simultaneously.

Other aspects, features, advantages, etc. will become apparent to one skilled in the art when the description of the invention herein is taken in conjunction with the accompanying drawings.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PRESENT INVENTION

For a detailed discussion of some structures and features suitable for use with the present invention, reference is made to U.S. Pat. No. 6,991,488, the entire disclosure of which is hereby incorporated by reference. It will be apparent to those skilled in the art how some of the details of U.S. Pat. No. 6,991,488 may be employed in the present invention and/or how one or more features of the present invention may be employed with the device(s) of U.S. Pat. No. 6,991,488.

Figure 1:
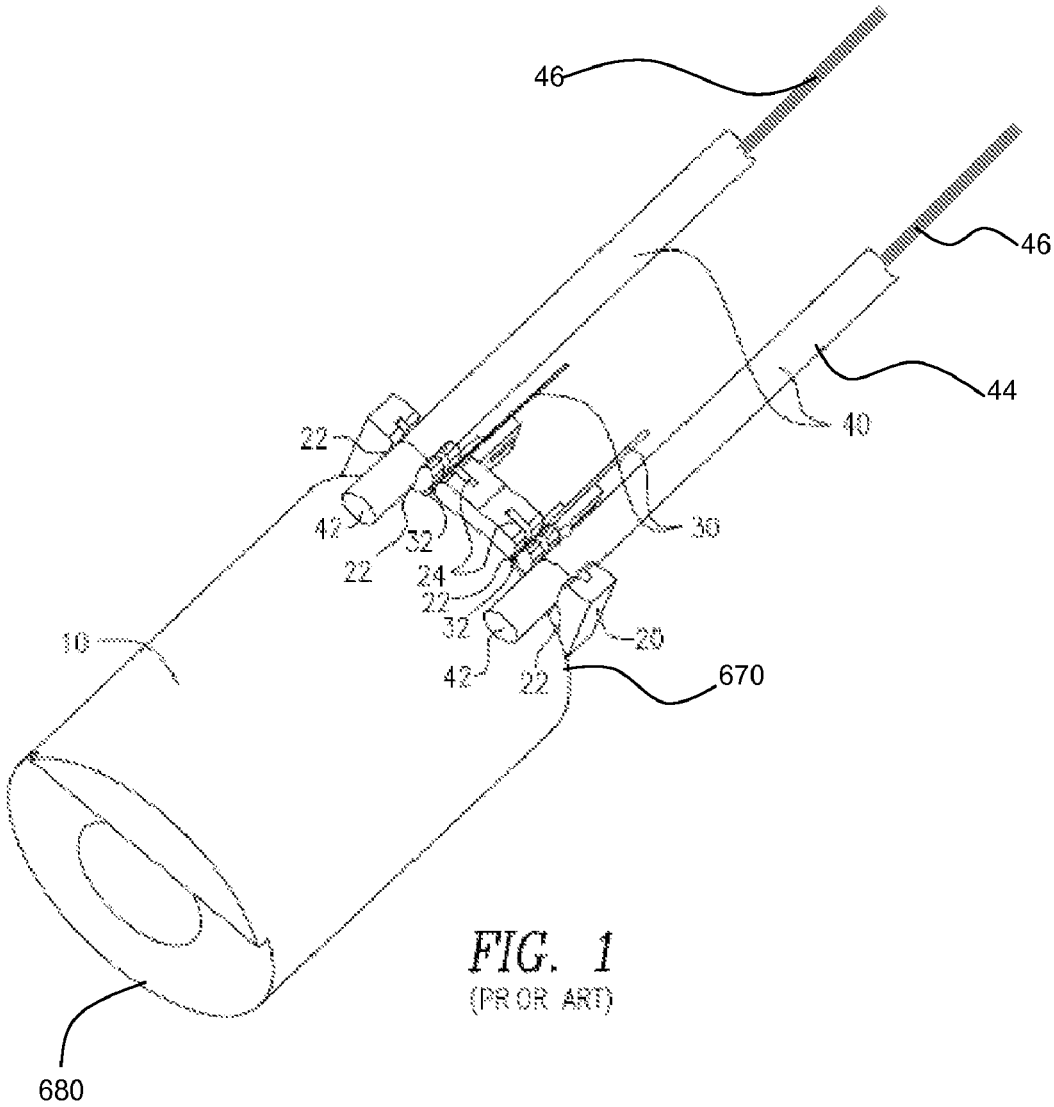
FIG. 1 (PRIOR ART)
FIG. 1 is a top perspective view of a prior art solenoid assembly showing a simple coil and coil bobbin with lead wires and magnet wires to which the teachings of the present invention may be applied.

FIG. 1 is a representation of a prior art solenoid assembly in which a simple coil 10 is wound on a bobbin 20. The bobbin 20 further comprises connector pockets 22 and connector slots 24. The ends 32 of a magnet wire 30 winding are pre-positioned and anchored in their appropriate slots 24. The ends 42 of the lead wires 40 are also pre-positioned in their slots 24. The lead wire 40 typically includes a strand of conductor wire 46 covered by a layer of insulation 44. The slots 24 hold the wires in exact positions across the pockets 22. Each of the pockets 22 is adapted to support a connector (not shown) and the lead wires 40. As is typical in the prior art, the pockets 22 are disposed on the bobbin 20 which is oriented at an exit end 670 (in contrast to opposite end 680) where the lead wires 40 exit away from the simple coil 10 so as to reduce overlap of the lead wires 40 and the simple coil 10. This orientation of the simple coil 10, bobbin 20 and lead wires 40 functions to reduce the potential of undesirable contact that may lead to a short circuit.

Figure 2A:
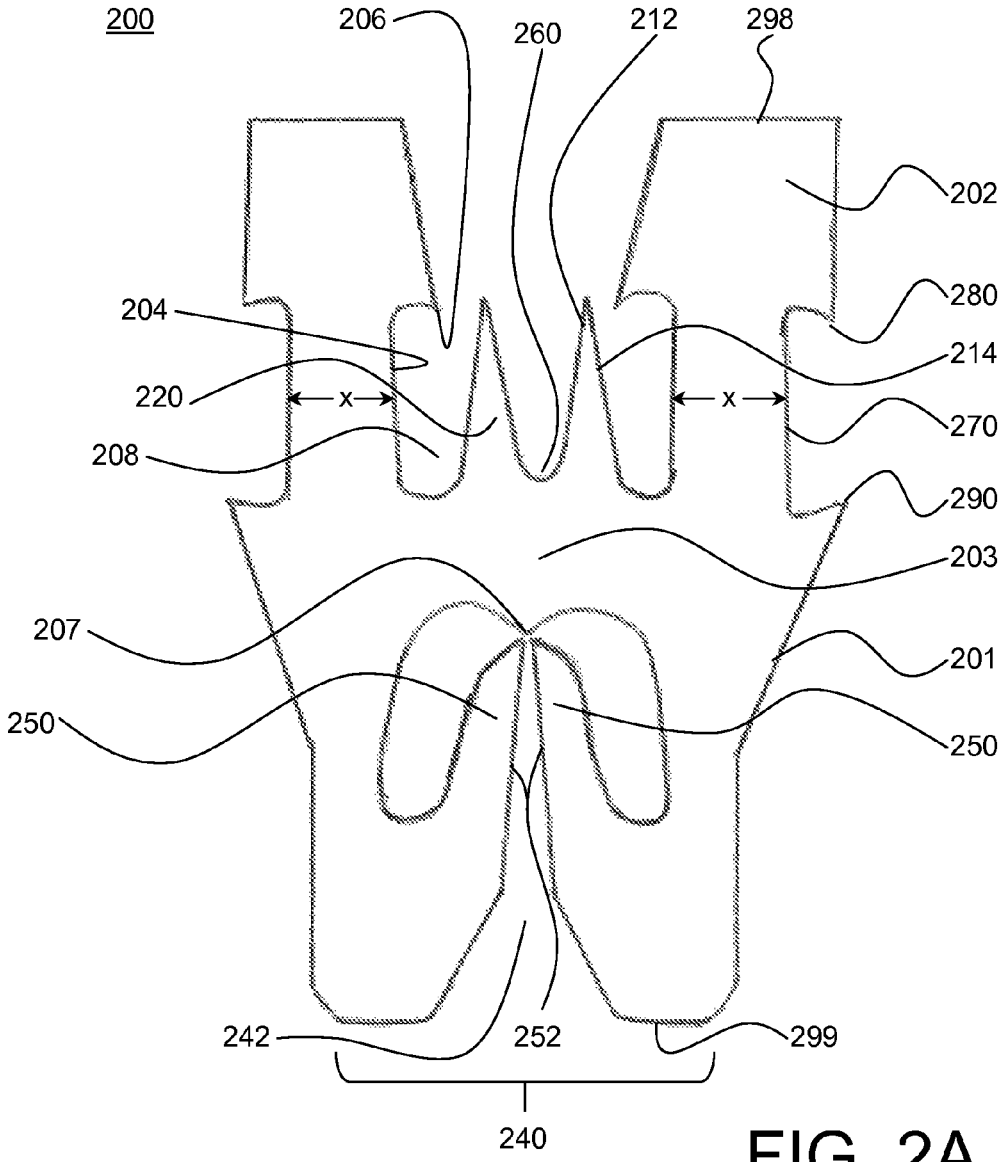
FIG. 2A is a front view of an embodiment of an insulation displacement connector of the present invention.
Figure 2B:
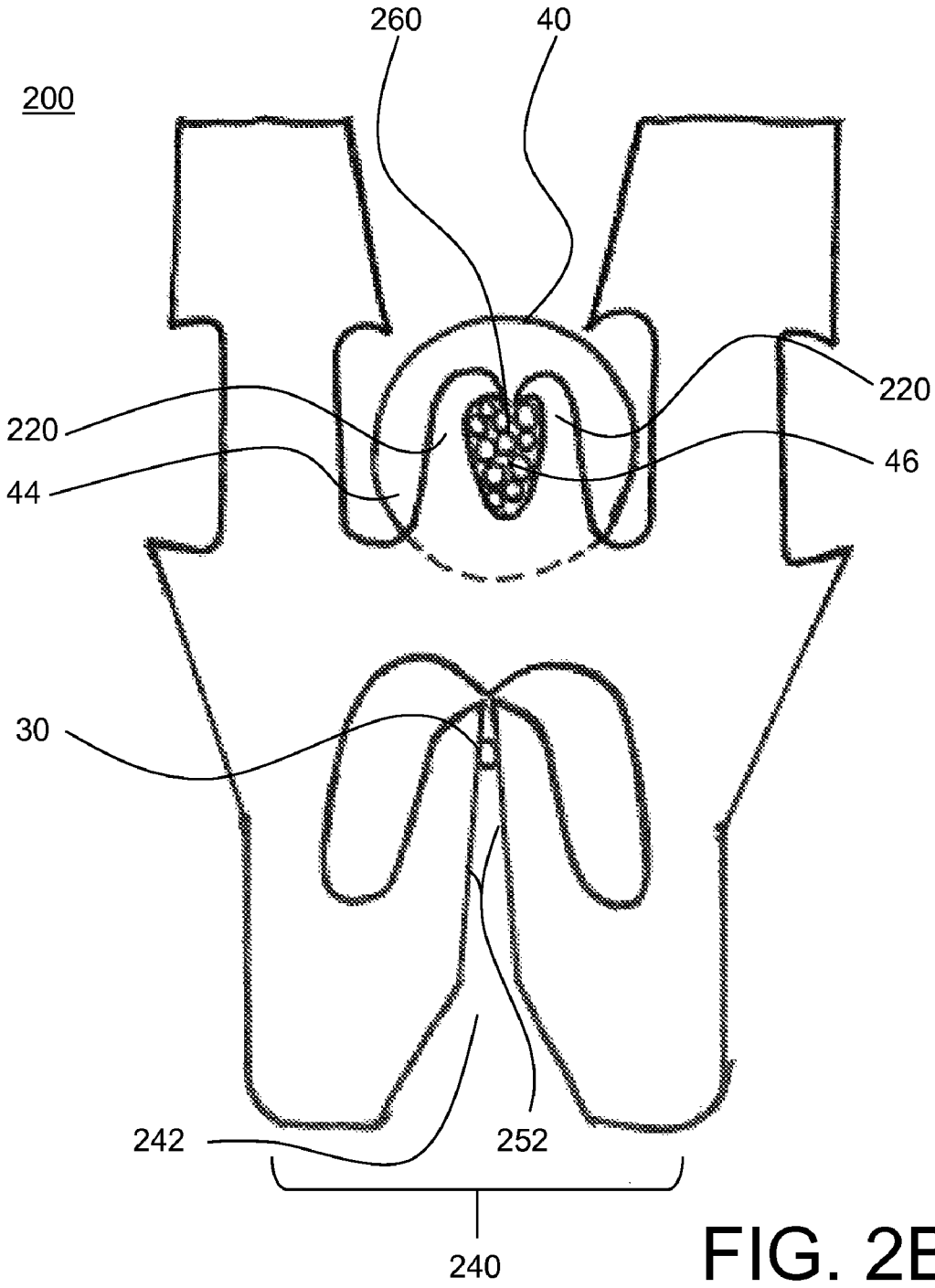
FIG. 2B is a front view of the insulation displacement connector of FIG. 2A after insertion of the magnet wire and the crimping/curling of the connector to enclose the conductor wires of the lead wire.

Now referring to FIGS. 2A and 2B, in accordance with one embodiment an insulation displacement connector 200 includes tangs 220 and posts 202 extending away from a body 203, and a fastener 240. As shown, tangs 220 and posts 202 may be oriented substantially parallel. Tangs 220 are located between the two posts 202.

Tangs 220 extend upwardly from body 203 and have inner walls 212 and outer walls 214. The inner walls 212 of the tangs 220 form a receiving pocket 260 having an opening oriented away from the body 203. The receiving pocket 260 functions to receive at least one wire, such as one or more lead wire 40 having conductor wire 46 and a layer of insulation 44. A portion of the insulation 44 may be stripped, to expose the underlying strand of conductor wire 46, at the location where the lead wire 40 contacts the receiving pocket 260. For example, the conductor wire 46 is positioned into the receiving pocket 260 such that the tangs 220 may be curled or crimped around the conductor wire 46. This provides the advantage of reducing inadvertent removal of the conductor wire 46 from the receiving pocket 260, and increases the amount of external force that the electrical connection can withstand before the connection is broken. The interior of pocket 260 may have any configuration suitable for receiving the wire 46, such as U-shaped, V-shaped or the like.

Posts 202 extend away from the body 203 in a direction opposite ends 299. Each of the posts 202 include inner walls 204. The posts 202 may further include a protrusion 206 that is a hook from an inner wall 204. The protrusion 206 acts to retain the lead wire by mechanically catching the insulation of a lead wire in a fashion similar to a barbed fishing hook. The posts 202 may also include one or more of detents 270, protrusions 280 that are hooks, and ends 298. Detent 270 and protrusions 280 provide an area for engaging connector 200 with a mounting medium, such as a plastic housing such as those known in the art. Protrusions 280 provide two advantages in the mounting function. It provides a mechanical catch or stop to prevent overinsertion of connector 200 into its mounting medium, preventing deformation of the end of the connector adjacent to fastener 240. The protrusions 280 may also engage the mounting medium by penetrating the material of the mounting medium which in many cases is susceptible to and/or designed for such penetration. This engagement stabilizes a lateral edge 201 of the connector 200, further preventing deformation of connector 200. Cavities 208 are between the tangs 220 and the posts 202 and are sized to permit an increase or decrease of the deformability of the posts 202 and tangs 220. For example, to reduce the deformability of the posts 202, the posts 202 may have a greater dimension X thereby reducing the area of the cavity 208. To increase the deformability of the posts 202, the dimension X of posts 202 may be reduced thereby increasing the area of the cavity 208. Cavities 208 also may be dimensioned to accommodate a wire 46 of a particular size. Cavities 208 may receive displaced insulation.

The fastener 240 includes opposing blade lateral edges 252 of blades 250, forming a slot 242. The blades 250 may be configured such that they approach each other along a centerline of the connector 200 and terminate proximate to body internal edge 207.

The fastener 240 may be sized and shaped to accommodate a magnet wire 30. The fastener 240 may snugly engage the magnet wire 30. For example, when the magnet wire 30 is inserted between the blade lateral edges 252, the force from the insertion creates tension to the blades 250 which may be spring loaded, which in turn places force upon the magnet wire 30. This helps to displace the insulation from the magnet wire and to maintain an effective, gas-tight mechanical and electrical contact between the blade lateral edges 252 and the magnet wire 30. The blade lateral edges 252 may also cut into the magnet wire 30, providing added strength to the connection.

The body 203 may include one or more of body lateral edges 201, body internal edge 207, wedges 290 and ends 299. Such parts may function to aid the connector 200 to snugly engage a complementary mounting medium, such as the connector slot 24 of a simple coil 10 (for example as in FIG. 1) or a plastic housing or a plastic bracket mounted on a printed circuit board such as those known in the art. For example, in one embodiment the body lateral edges 201 extend from the wedge 290 to the ends 299 and may be sized and shaped to snugly engage a corresponding shaped recess of the mounting medium.

Wedges 290 are formed along and extend outwardly from body lateral edges 201. In this embodiment wedges 290 are aligned from the centerline of connector 200, between ends 298 and 299. Wedges 290 may provide a mechanical catch or stop to prevent overinsertion of the connector 200 into the mounting medium, preventing deformation of the end 299 of the connector 200 adjacent to the fastener 240. The wedges 290 may also provide added stability to the remainder of the connector 200 and may further function to prevent slippage and inadvertent removal of the connector 200 from the mounting medium by mechanically catching the mounting medium and adding surface area that is in contact with the mounting medium, increasing friction between the mounting medium and the connector 200.

The connector 200 is preferably a planar piece of conductive material, such as but not limited to metal. The connector 200 may be produced by progressive die stamping, as is known in the prior art.

Figure 2C:
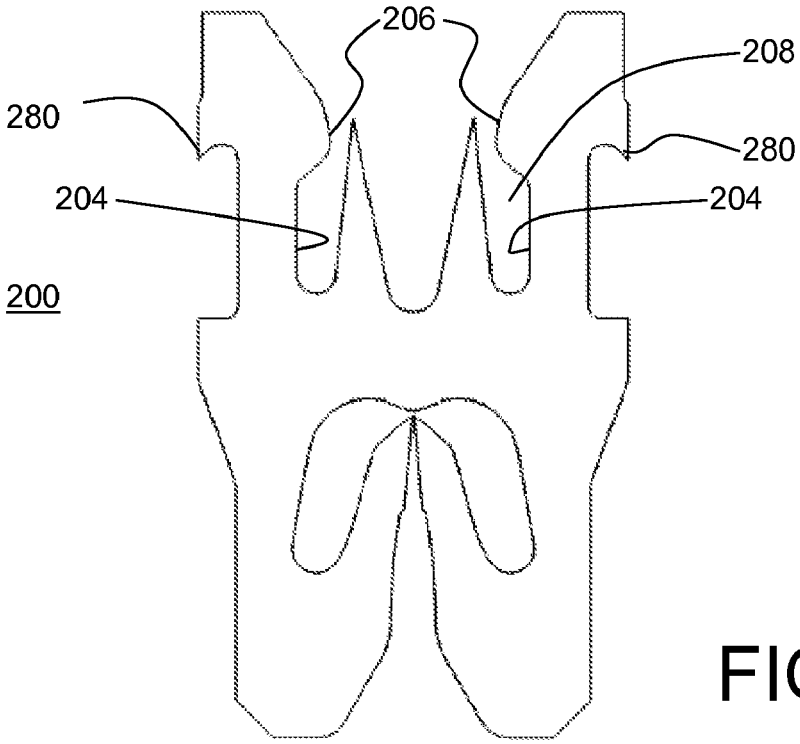
FIG. 2C is a front view of another embodiment of an insulation displacement connector of the present invention.

Now referring to FIG. 2C, another embodiment of an insulation displacement connector 200 is shown wherein the protrusion 206 is a bump extending from the inner wall 204. The protrusion 206 extends into cavity 208 and is sized and shaped to communicate with a crimping tool that functions to curl the tangs 220. As the crimping tool curls the tangs 220, it also acts upon the protrusions 206 by forcing them apart and thereby also deforming the posts 202 to expand outwards and to force the protrusions 280 that are hooks into the surrounding bobbin 20. Such action also increases the frictional reaction force against which the crimp of the tangs 220 is formed.

Figure 2D:
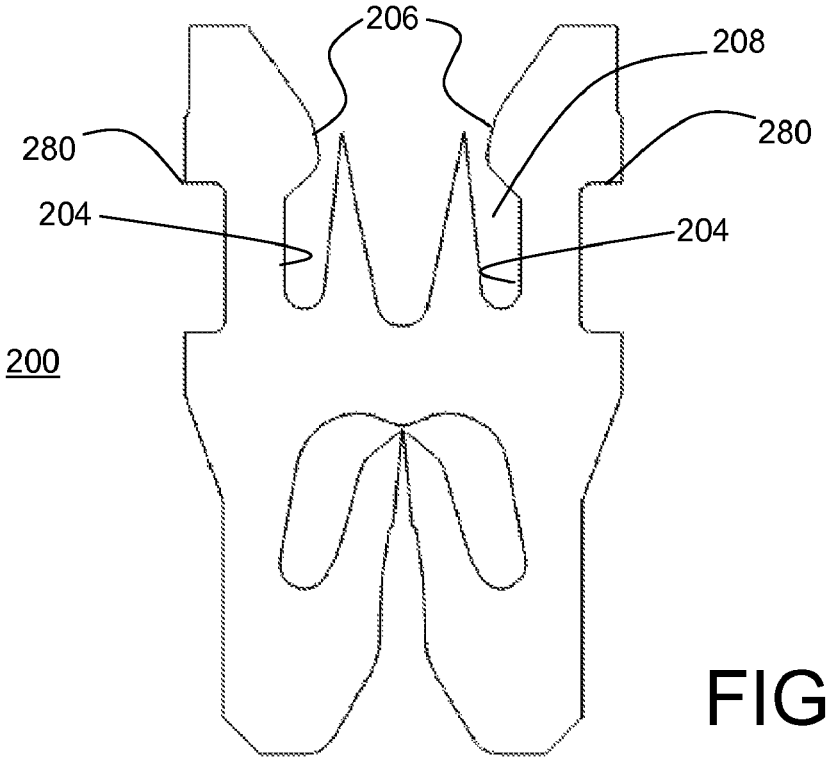
FIG. 2D is a front perspective view of another embodiment of an insulation displacement connector of the present invention.

Now referring to FIG. 2D another embodiment of an insulation displacement connector 200 is shown wherein the protrusion 206 is a bump extending from the inner wall 204. Here, the protrusion 280 is not a hook.

Figure 2E:
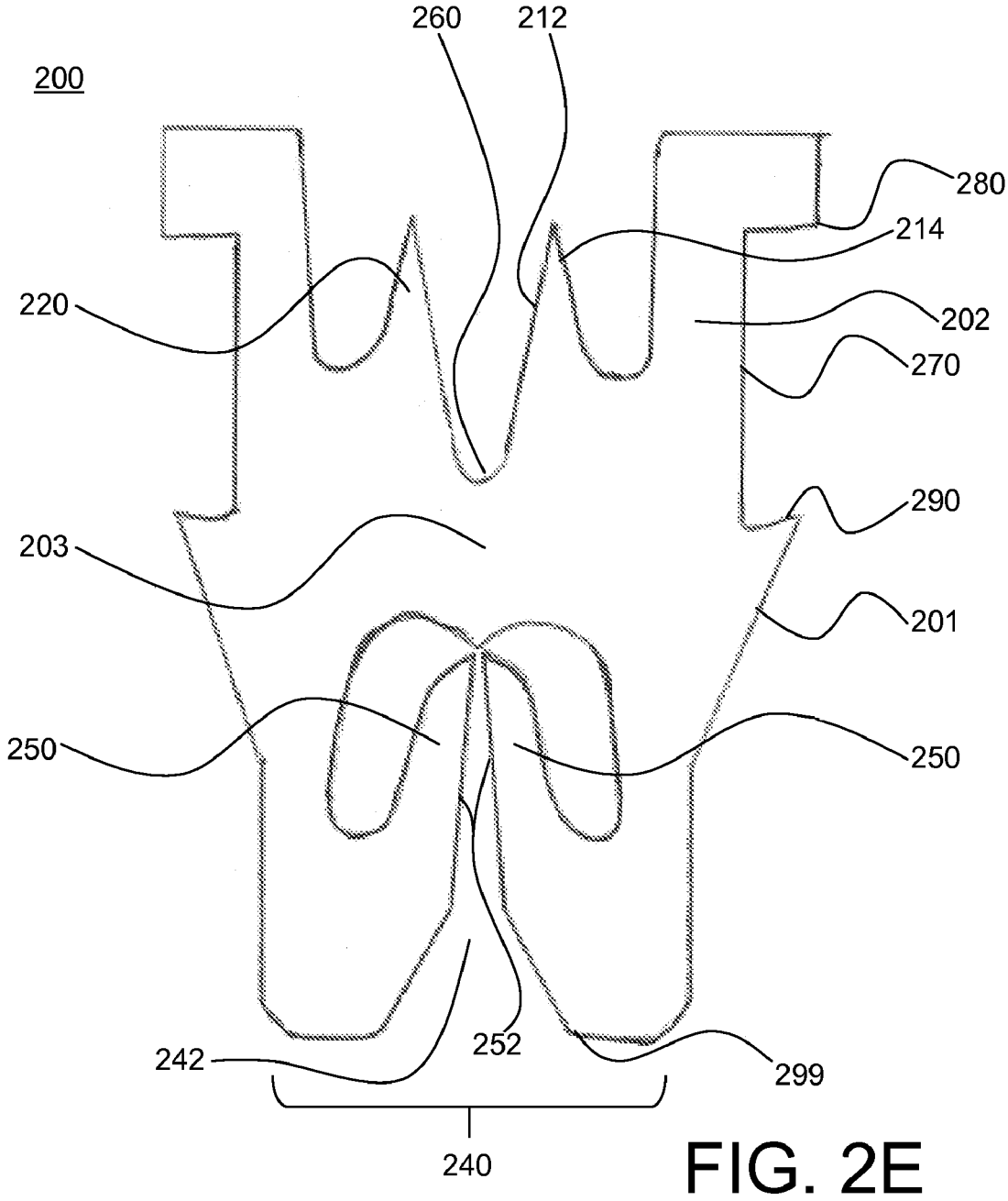
FIG. 2E is a front view of another embodiment of an insulation displacement connector of the present invention.

Now referring to FIG. 2E, another embodiment of an insulation displacement connector 200 is shown wherein the outer walls 214 of the tangs 220 are short relative to the inner walls 212. In such an embodiment the shorter outer walls 214 function to provide strength and support to the tangs 220 as the tangs 220 are curled around the conductor wire 46. Also, one or both of the posts 202 can be wider than as shown in the embodiment of FIG. 2A and function to provide strength and stability to the connector 200 as the tangs 220 are curled and crimped. The protrusions 280 may be more pronounced as compared to the embodiment of FIG. 2A to provide strength and stability to the connector 200 as the tangs 220 are curled and crimped.

Figure 2F:
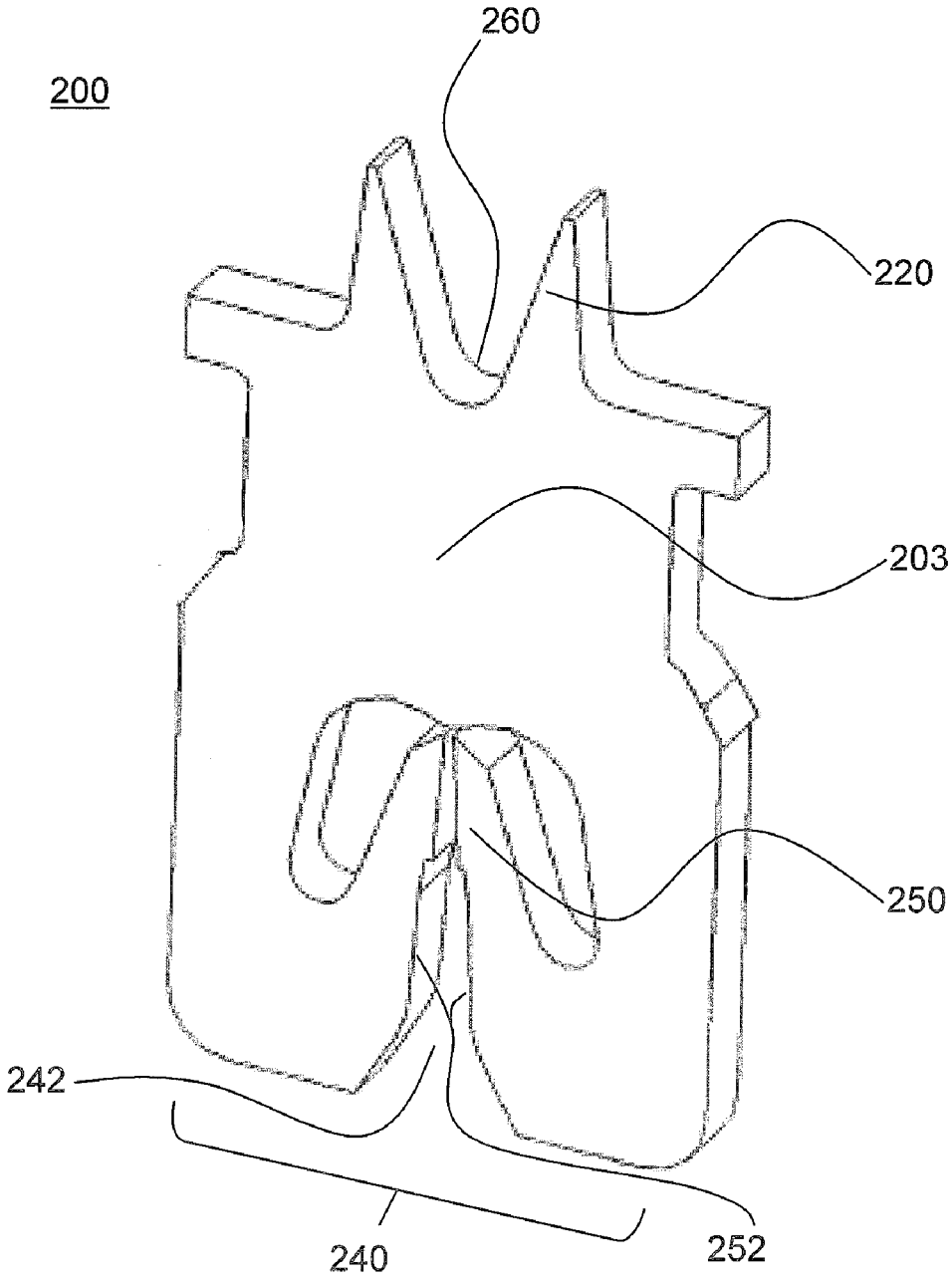
FIG. 2F is a front perspective view of another embodiment of an insulation displacement connector of the present invention.
Figure 2G:
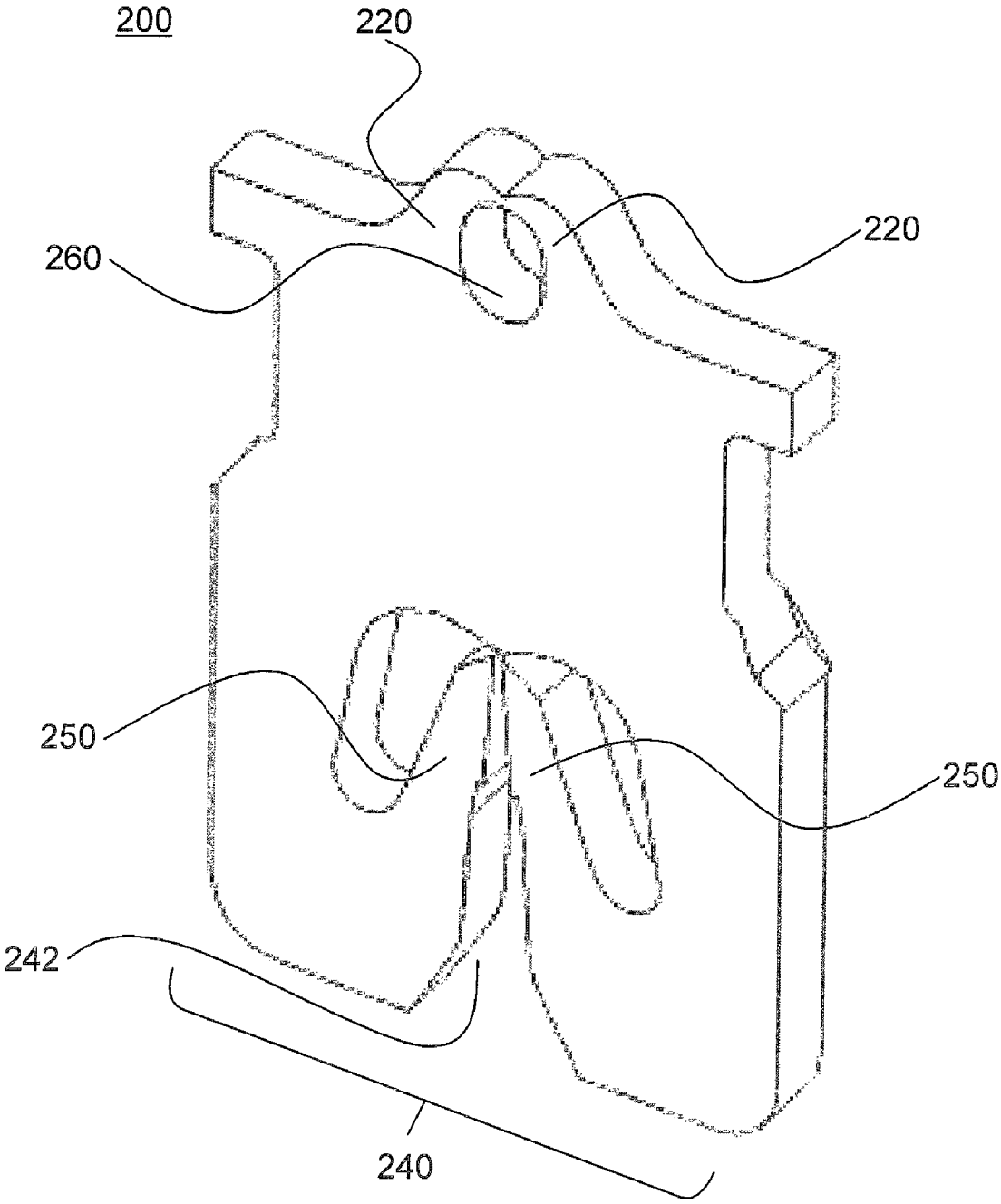
FIG. 2G is a front perspective view of the insulation displacement connector of FIG. 2F after the crimping/curling of the connector.

Now referring to FIGS. 2F-2G, in another embodiment a connector 200 does not include posts. As shown in FIG. 2G, when the conductor wire 46 is positioned into the receiving pocket 260 the tangs 220 may be curled and crimped to create a secure electrical connection between a lead wire (not shown) and the connector 200.

Figure 2H:
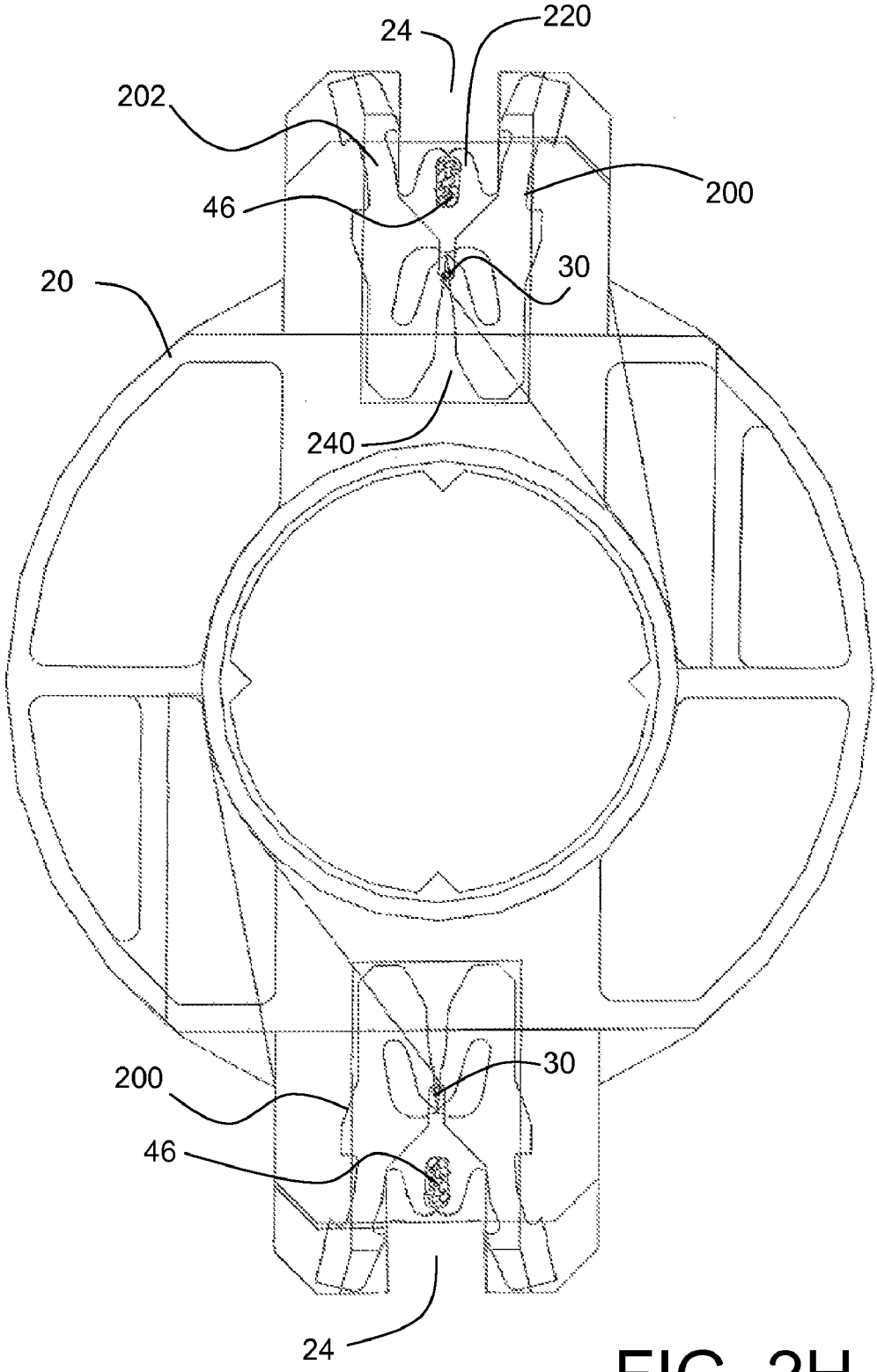
FIG. 2H is a front view of a bobbin employing two insulation displacement connectors of FIG. 2A.

In one embodiment a bobbin 20 may include two connector slots 24 opposite to one another as shown in FIG. 2H. Connectors 200 that are positioned in the connector slots 24 so that the receiving pockets 260 face away from one another and aid in creating a tight and secure connection with the lead wires 40, as will be discussed below.

It is contemplated that a magnet wire 30 may be connected to the insulation displacement connectors described herein in various ways. The following embodiments shown in FIGS. 3A-4B depict additional variations of the electrical connection between an insulation displacement connector and a magnet wire.

Figure 3A:
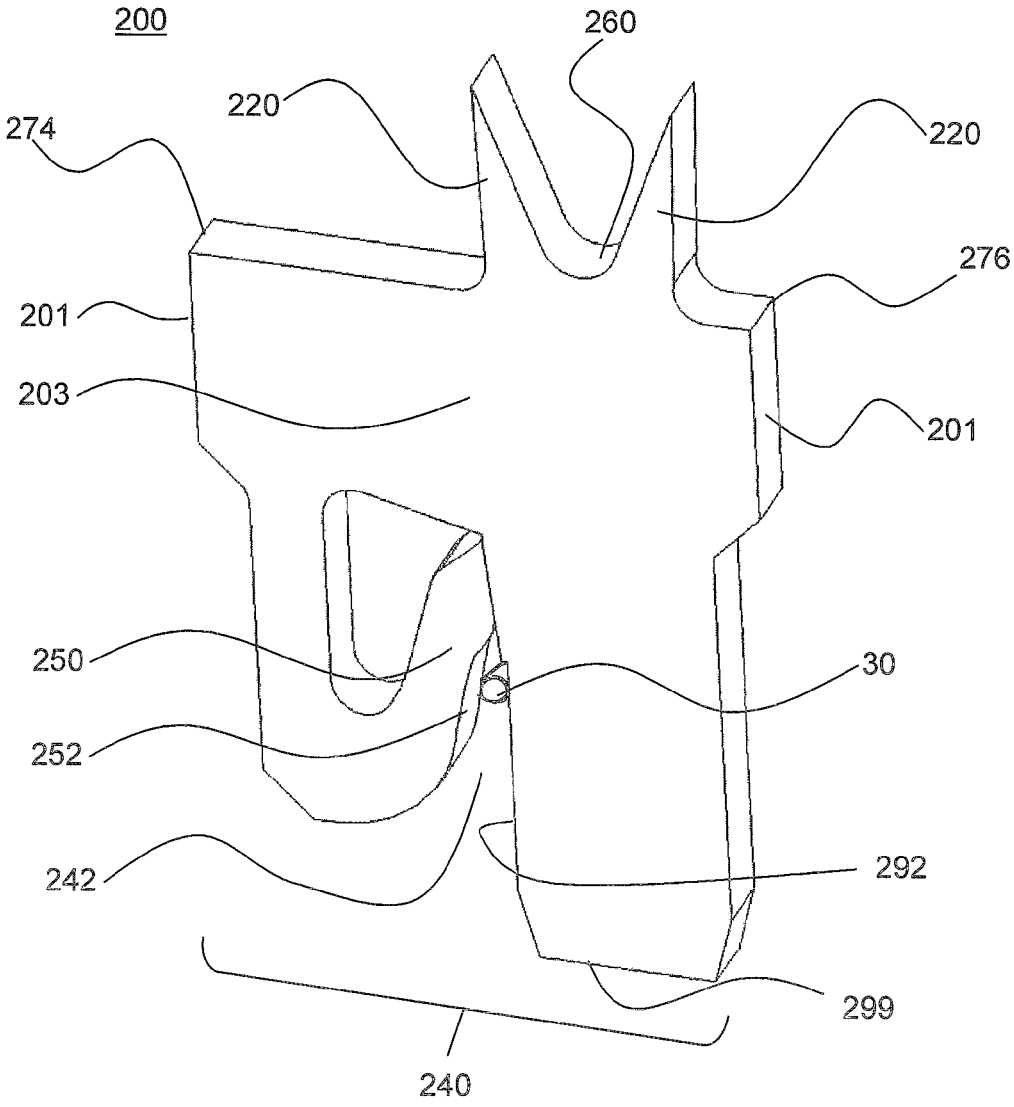
FIG. 3A is a front perspective view of another embodiment of an insulation displacement connector of the present invention.
Figure 3B:
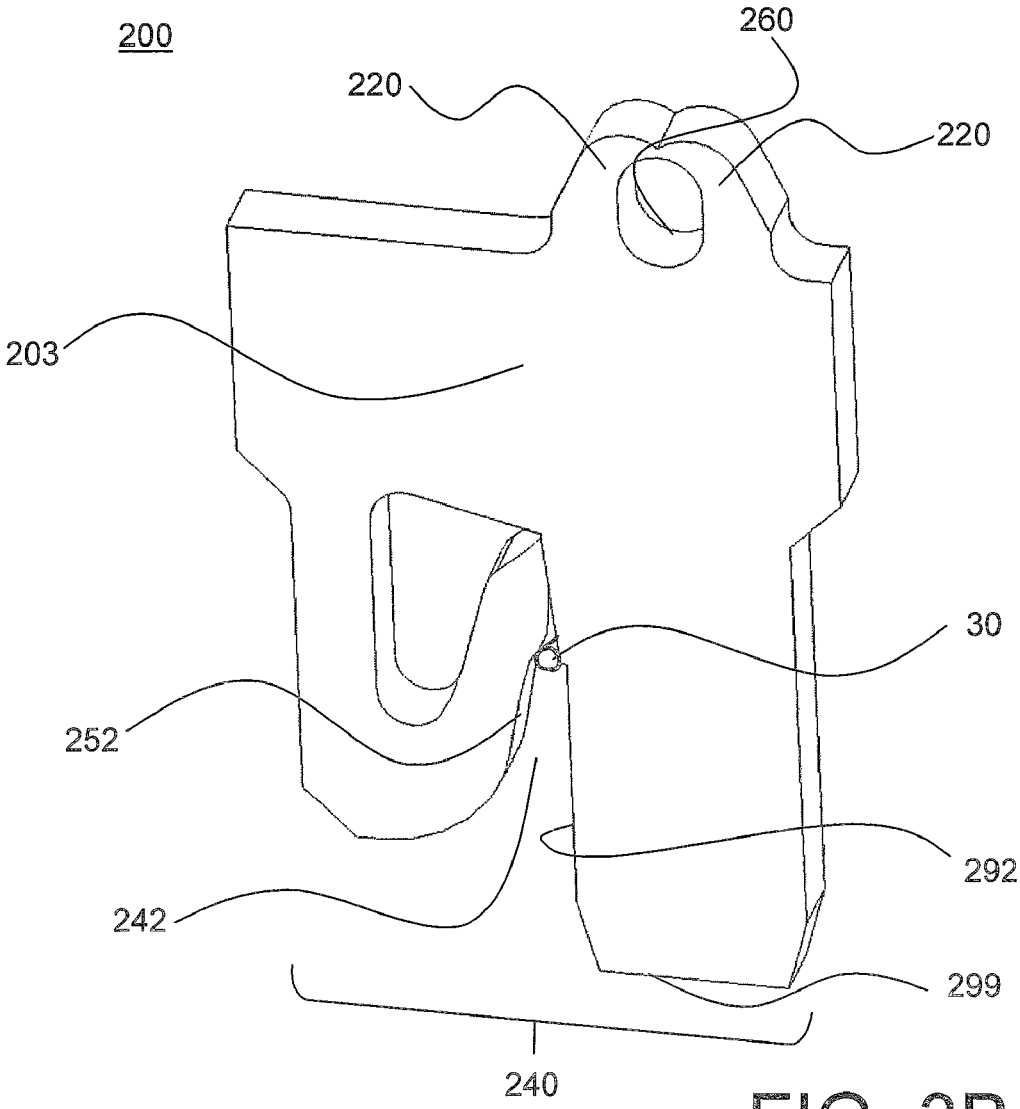
FIG. 3B is a front perspective view of the insulation displacement connector of FIG. 3A after the crimping/curling of the connector.

Now referring to FIGS. 3A-3B, another embodiment of a connector is disclosed. As shown, a connector 200 includes tangs 220 extending from body 203 forming a pocket 260. The tangs 220 may be disposed in any suitable location between the upper edge ends 274 and 276. As shown, the magnet wire 30 may be disposed within a fastener 240. The fastener 240 includes opposing body edge 292 and blade lateral edge 252 forming a slot 242. As the magnet wire 30 is inserted between the blade lateral edge 252 and body edge 292, the force from the insertion holds the magnet wire 30 in place and may help to displace the insulation from the magnet wire 30 and to maintain an effective, gas-tight mechanical and electrical connection between the blade lateral edge 252 and body edge 292 and the magnet wire 30. The blade lateral edge 252 and body edge 292 may also cut into the magnet wire 30, providing added strength to the connection. The body 203 may extend towards the end 299 of the connector 200 and functions to stabilize the connector 200 as the tangs 220 are curled.

Figure 4A:
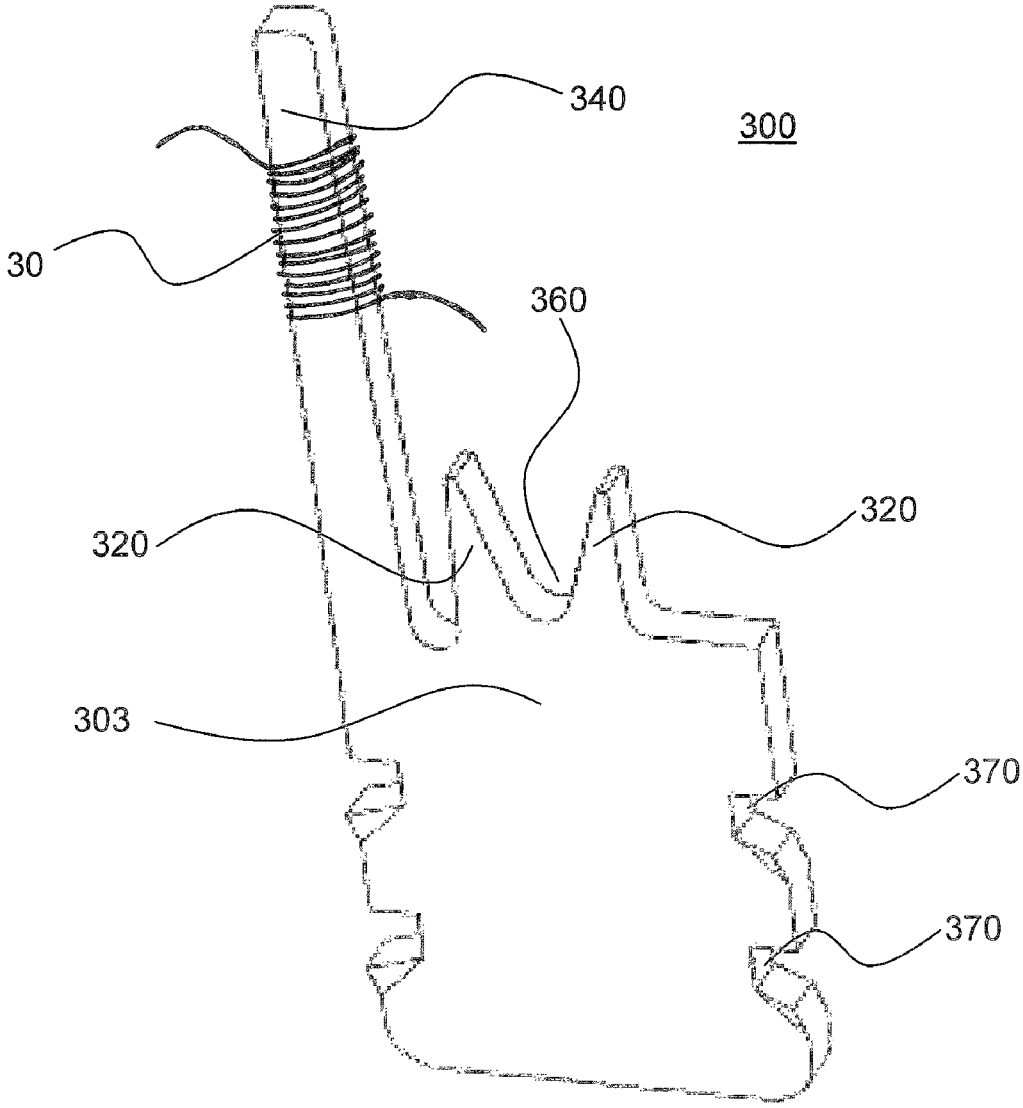
FIG. 4A is a front perspective view of another embodiment of an insulation displacement connector of the present invention.
Figure 4B:
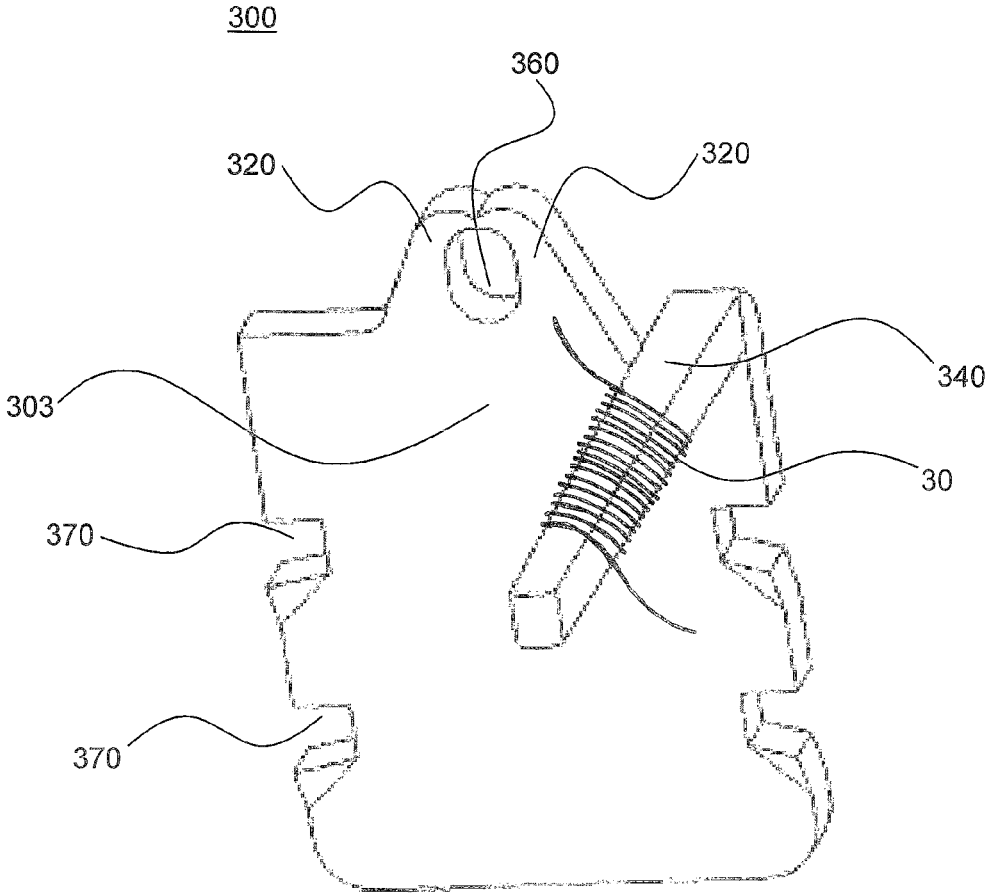
FIG. 4B is a front perspective view of the insulation displacement connector of FIG. 4A after the crimping/curling of the connector.

Now referring to FIG. 4A another embodiment of an electrical connector is shown adapted to accommodate a magnet wire 30. As shown, a connector 300 includes tangs 320 extending from body 303 form a pocket 360. As shown, the magnet wire 30 may be disposed within a fastener 340 in the form of an elongated post onto which a magnet wire may be wrapped, and extends away from the body 303. In such embodiment, the body 303 may further include detents 370 that function to provide a region to snugly engage a corresponding shaped recess of a mounting medium. The wrapping of the magnet wire 30 functions to anchor the end of the magnet wire 30 and to establish an electrical connection between the magnet wire 30 and the connector 300. A connector 300 having fastener 340 may be employed in situations where the magnet wire may be susceptible to breakage, for example when the magnet wire 30 is thin. For example, the fastener 340 may be used when the magnet wire 30 is less than about 34 gauge. The body 303 may extend towards the end opposite to the receiving pocket 360 and functions to stabilize the connector 300 as the tangs 320 are curled. Now referring to FIG. 4B the fastener 340 may be bent or positioned in various orientations to allow the connector 300 to fit a complementary mounting medium and/or position the magnet wire 30 to optimize an electrical connection. For example, the fastener 340 may be bent downwards at an angle suitable to prevent breakage and/or disconnection of the magnet wire 30 and reduce the likelihood of short circuits.

Figure 4C:
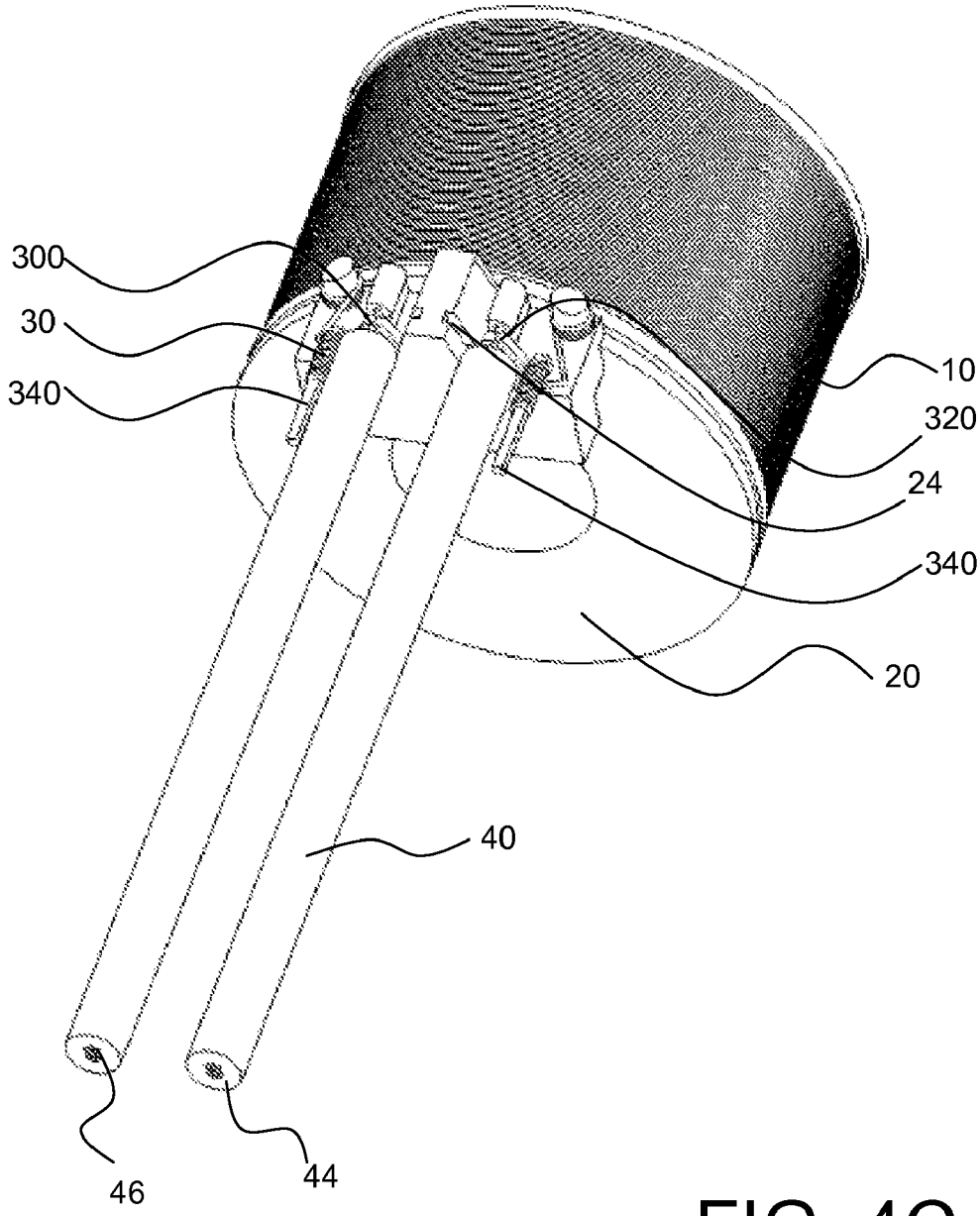
FIG. 4C is a top perspective view of a solenoid assembly employing the insulation displacement connector of FIG. 4A.
Figure 4D:
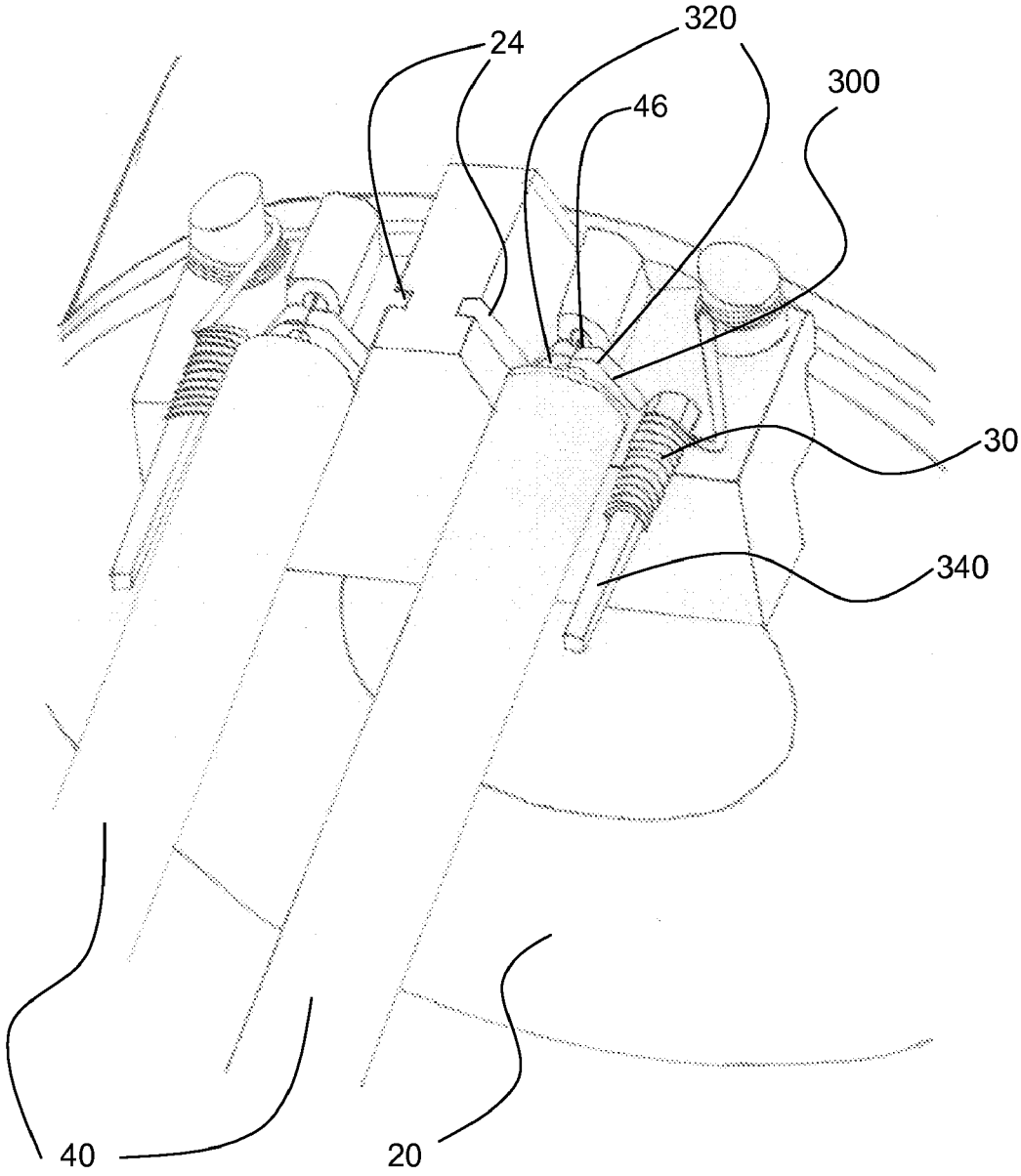
FIG. 4D is a magnified view of the detail of FIG. 4C in accordance with one embodiment of the invention.

Now referring to FIGS. 4C and 4D, the connector 300 may be positioned in a slot 24 on the bobbin 20. As shown, the tangs 320 are curled and crimped around the conductor wire 46 of the lead wire 40 and the magnet wire 30 is wrapped around fastener 340, forming an electrical connection.

In accordance with the present invention, one embodiment of a method for making an electrical connection between a wire 40 and a connector 200 may include placing conductor wire 46 in the receiving pocket 260 and curling the deformable tangs 220 around the conductor wire 46 such that a tight and secure electrical connection is made that is resistant to external forces and movement. The method may include cutting, pushing aside and/or removing the insulating layer 44 of the wire 40 to expose the underlying conductor wire 46 of the wire 40, placing the exposed conductor wire 46 in the receiving pocket.

In another embodiment, a method for making an electrical connection between at least one wire 40 and a connector 200 may include the additional step of inserting the connector 200 into a connector slot 24 of a bobbin 20, prior to placing the wire 40 in a connector receiving pocket. Such a method may also include further pushing the connector 200 into the connector slot 24 of the bobbin 20 as the tangs 220 are being crimped around the conductor wire 46.

Figure 5A:
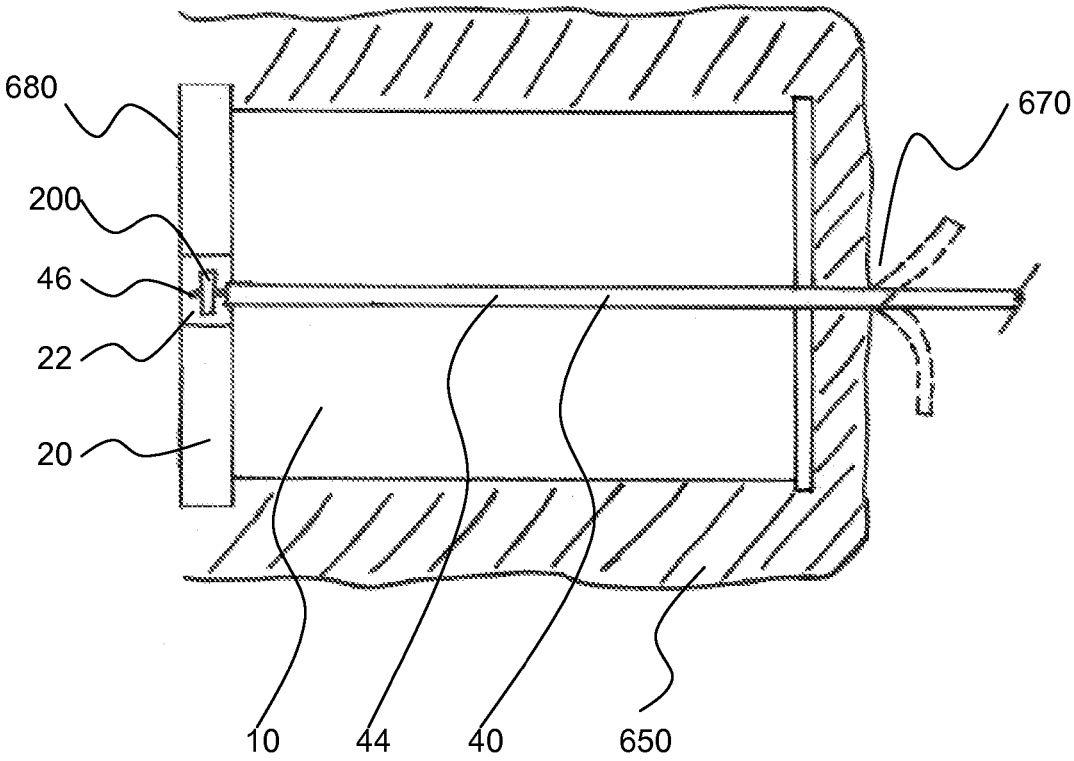
FIG. 5A is a cross-sectional view of one embodiment of an encapsulated solenoid assembly with a straight lead wire according to the present invention.

Now referring to FIG. 5A, in one embodiment, a bobbin 20, having first and second terminal ends, that is encapsulated by an encapsulation 650 includes a pocket 22 located at the end (e.g., the first terminal end) of the bobbin 20 that is opposite the end (e.g., the second terminal end) of the bobbin 20 from which a lead wire 40 exits the bobbin 20. The end of the bobbin from which the lead wire 40 exits is defined herein as the lead wire exit end 670, and the opposing end (e.g., where the pocket 22 is located) is defined as the opposite end 680. Pocket 22 is dimensioned to receive a connector such as connector 200.

Encapsulation is well known to the skilled artisan and functions to isolate the portion of the length of lead wire 40 located near the simple coil 10 and bobbin 20, from the connector 200 and reduce and/or prevent undesired electrical connection(s). In FIG. 5A, the location of the bobbin 20 and pocket 22 are reversed as compared to the typical configuration of the prior art solenoid assembly as illustrated in FIG. 1 in which the bobbin, pocket and connector are at the lead wire exit end. In the present embodiment, the increased distance from the electrical connection of the lead wire 40, connector 200 and magnet wire 30, to the lead wire exit end 670 provides considerable resistance to even abusive attempts to pull out the lead wire 40 as the increased length of lead wire 40 absorbs and dissipates the external forces and disturbances before reaching the electrical connection.

Figure 5B:
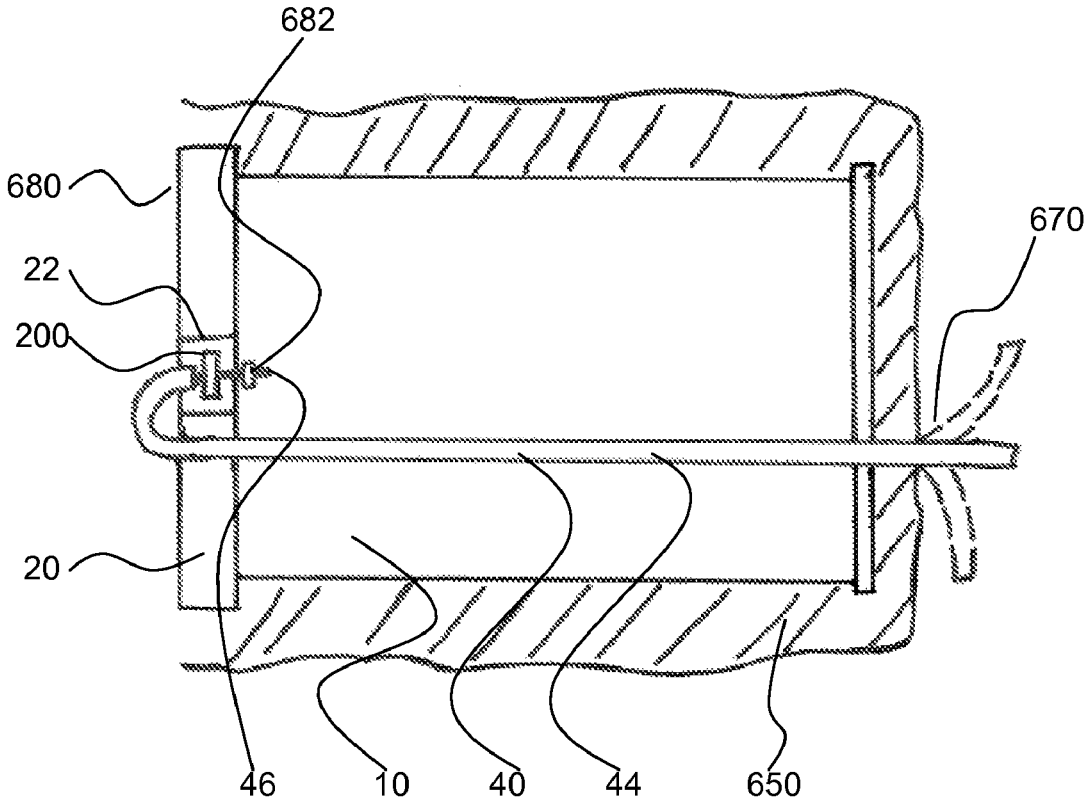
FIG. 5B is a cross-sectional view of one embodiment of an encapsulated solenoid assembly with a curved lead wire according to the present invention.
Figure 5C:
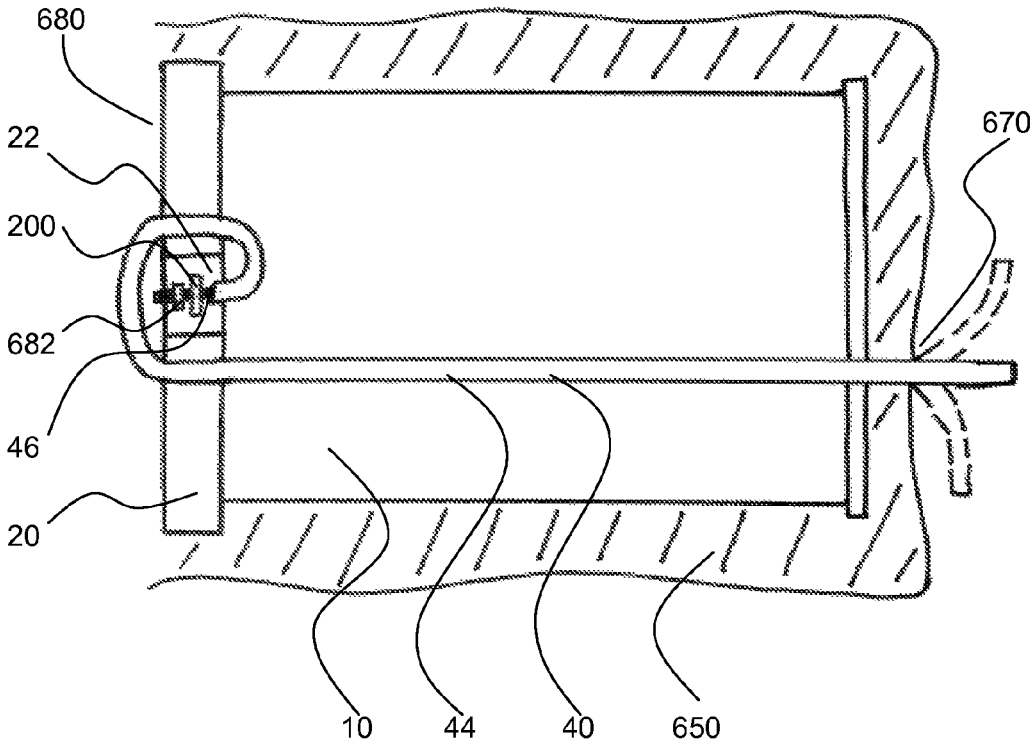
FIG. 5C is a cross-sectional view of one embodiment of an encapsulated solenoid assembly with a curved lead wire according to the present invention.

Additional embodiments are disclosed in FIGS. 5B-5C. In one embodiment, a tight 180 degree (u-turn) (FIG. 5B) or 360 degree (FIG. 5C) curve may be applied to the lead wire 40 immediately before the connector 200 contact. Such orientations provide considerably increased resistance to disruption of the electrical connection.

Figure 5D:
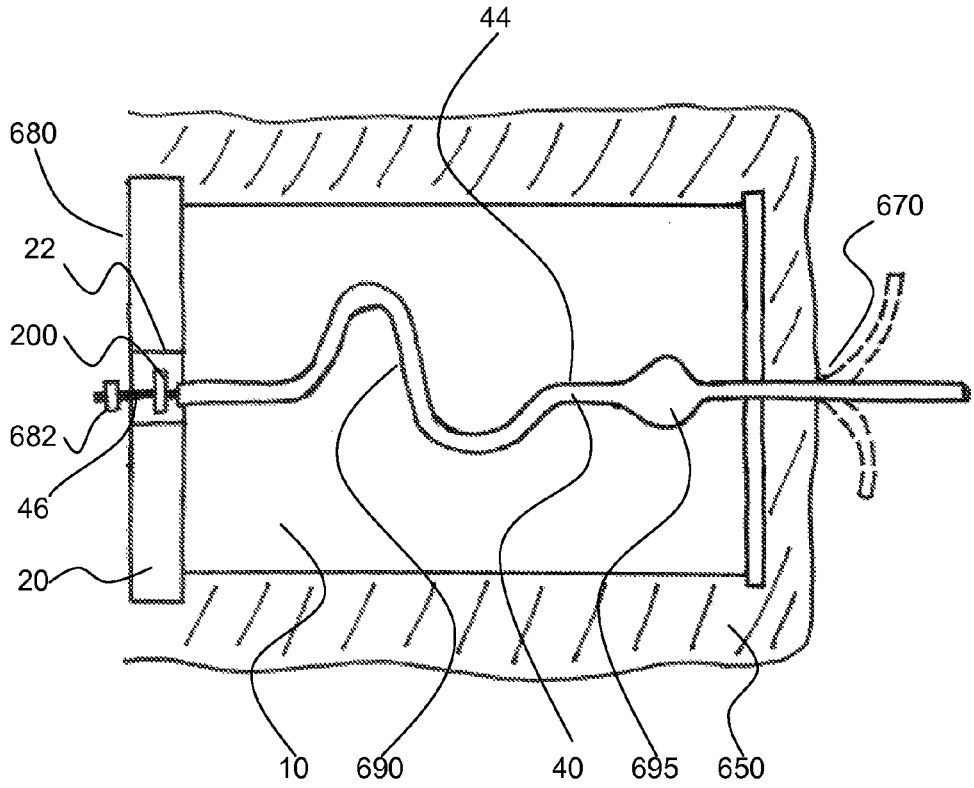
FIG. 5D is a cross-sectional view of one embodiment of an encapsulated solenoid assembly with a kinked and embossed lead wire according to the present invention.

Another embodiment is disclosed in FIG. 5D. The length of lead wire 40 between the connector pocket 22 and the lead wire exit end 670 may include one or more or a combination of kinks 690 and/or embossments 695. The kinks 690 and/or embossments 695 provide considerable resistance to disruption of the electrical connection. The kinks 690 and/or embossments 695 may also provide isolation of the contact against external wire distortion-produced disturbances.

If additional keying of the insulation or further snubbing of the disturbing forces is desired or required, one or more crimp clips 682, or other equivalent device known to a skilled artisan, may be utilized. Each of the examples illustrated in FIGS. 5B-5D and 6A-6B include one or more crimp clips 682.

Figure 6A:
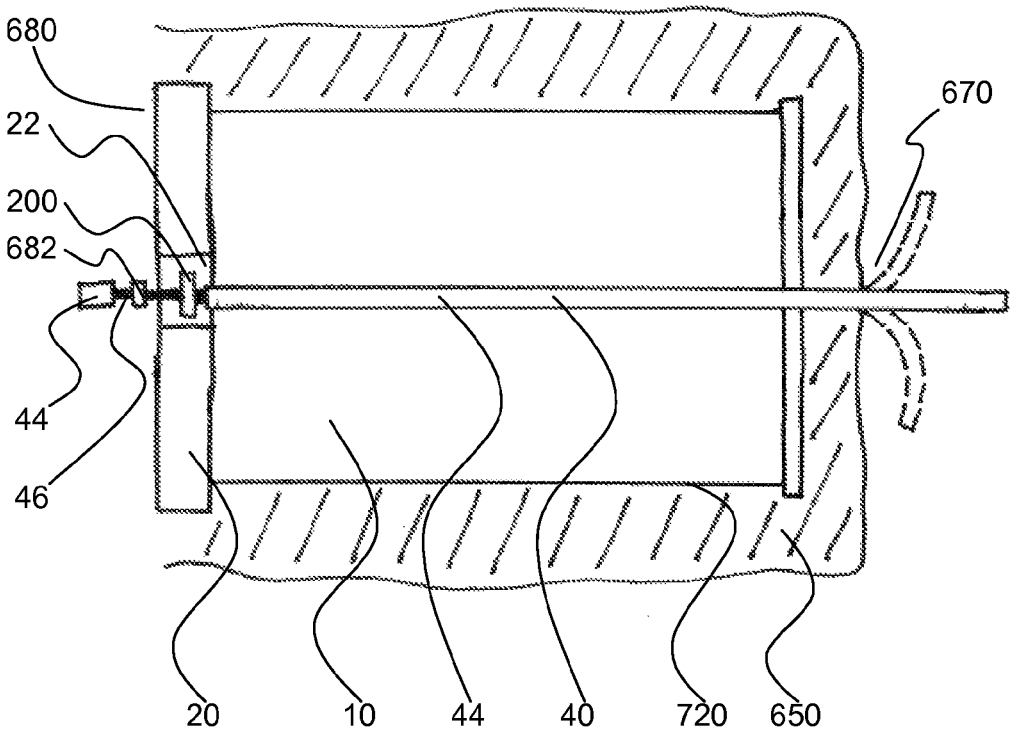
FIG. 6A is a cross-sectional view of one embodiment of an encapsulated solenoid assembly with a crimp clip according to the present invention.

Now referring to FIG. 6A, the lead wire 40 may have one or more crimp clips 682. For example the crimp clip 682 may be directly crimped around the conductor wire 46 where the insulation 44 is stripped from or moved along the length of the lead wire 40 to expose the conductor wire 46. In the illustrated embodiment, the insulation 44 has been partially stripped such that a portion of the insulation 44 at the end of the lead wire 40 was cut and pushed along the length of the lead wire 40 so that the re-positioned insulation 44 protrudes past the terminal end of the conductor wire 46 of the lead wire 40. Even when the lead wire 40 and crimp clip 682 are positioned over the winding of the simple coil 10, the extra portion of insulation 44 at the end of the lead wire 40 acts as a spacer and prevents the crimp clip 682 from contacting the winding coil. This reduces the likelihood of short circuits and allows a reduction in the amount (e.g., the effective thickness) of an insulating tape 720 that is typically wrapped around the simple coil 10 to insulate it from wires such as the lead wire 40 and/or the magnet wire 30. By way of example, two thicknesses of 0.007 inch insulating tape 720 may be needed rather than the typical three thicknesses of insulating tape 720 required to reduce the likelihood of short circuits.

Figure 6B:
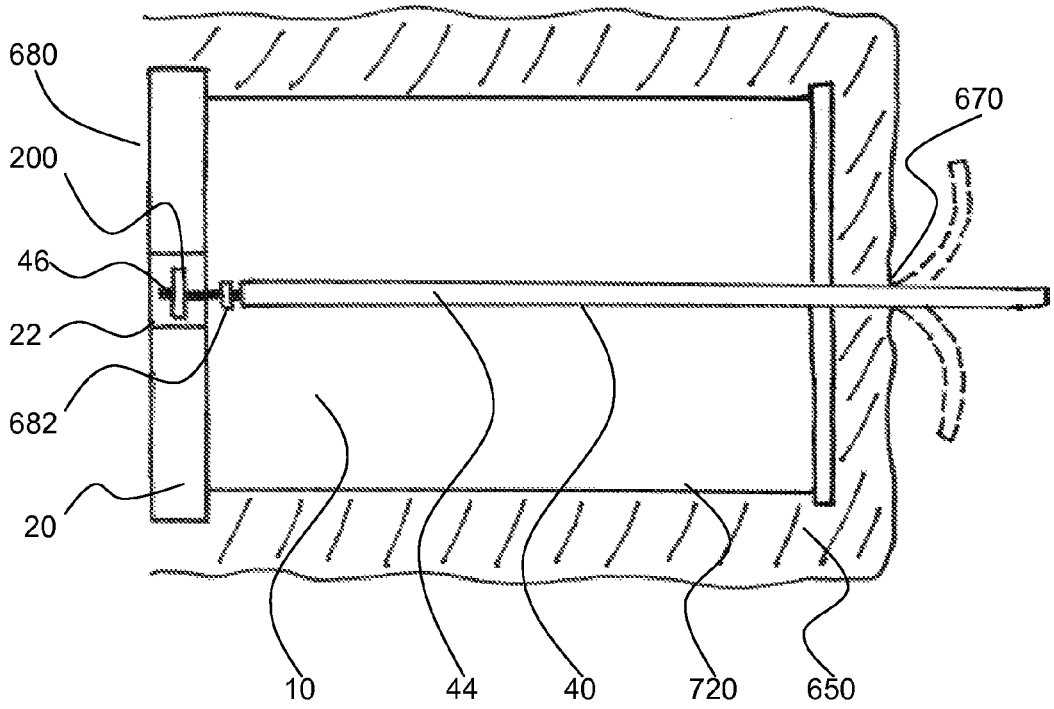
FIG. 6B is a cross-sectional view of one embodiment of an encapsulated solenoid assembly with a brass crimp clip according to the present invention.

Another embodiment including a crimp clip 682 is depicted in FIG. 6B. A crimp clip 682 may be positioned between the lead wire exit end 670 and the connector 200. The encapsulation 650 functions to isolate the portion of the lead wire 40 near to the simple coil 10 and bobbin 20 from the connector 200. When an external force is applied to the lead wire 40, the force is absorbed by the encapsulation 650 via the crimp clip 682, thus preventing any disturbance of the contacts between the lead wire 40 and the connector 200, and the connector 200 and the magnet wire 30. In this embodiment, the risk of short circuiting is reduced since the crimp clip 682 is isolated from the magnet wire 30 not only by the insulating tape but also by the encapsulation 650.

Crimp clip 682 is any suitable material known to the skilled artisan such as brass.

Now referring to FIGS. 7A-7F another aspect of the present invention includes a device 800 that functions to connect one or more wires, such as lead wires 40, to a connector 200 pre-positioned in a connector slot 24 of a bobbin 20 that has been placed on the device 800. The device 800 operates to aid in positioning the one or more wires over the receiving pocket 260 and to curl the deformable tangs 220 around the one or more wires. The device 800 may also function to force the connector 200 further into the connector slot 24 and/or deform and expand the posts 202, thereby creating a tight fit between the connector 200 and connector slot 24 and/or a tight and secure connection between the connector 200 and magnet wire 30.

FIGS. 7A-7F illustrate a device 800 that functions to connect one or more wires including but not limited to lead wire 40, to one or more connectors 200. The device 800 includes a work station 824 having a stop guide rocker 826, one or more crimping tools 828 and a housing 802. The device 800 may use any suitable means for driving the crimping tool 828, such as a manual drive or a motorized mechanism, an example of which is described hereinbelow. The stop guide 826 may be adapted to receive and hold in position a work-piece 920 of various shapes and sizes so that as the crimping tool 828 moves, contact is made with the corresponding connectors 200 for creating a secure connection to the one or more wires 40 and 30. In one embodiment, the work-piece 920 is defined as a solenoid coil 10, bobbin 20 having at least one connector slot 24 in which a connector 200 has been placed, and a pre-positioned magnet wire 30 connected to the connector 200.

The device 800 may further include a work-piece slide 820 for containing a plurality of work-pieces 920. The slide 820 may be positioned relative to the stop guide rocker 826 so that gravitational forces feed a work-piece 920 into position on the stop guide rocker 826 such that the work-piece 920 is aligned with the crimping tool 828. Replenishment of the work-piece slide 820 may be done manually or automatically according to methods known to the skilled artisan.

Figure 7A:
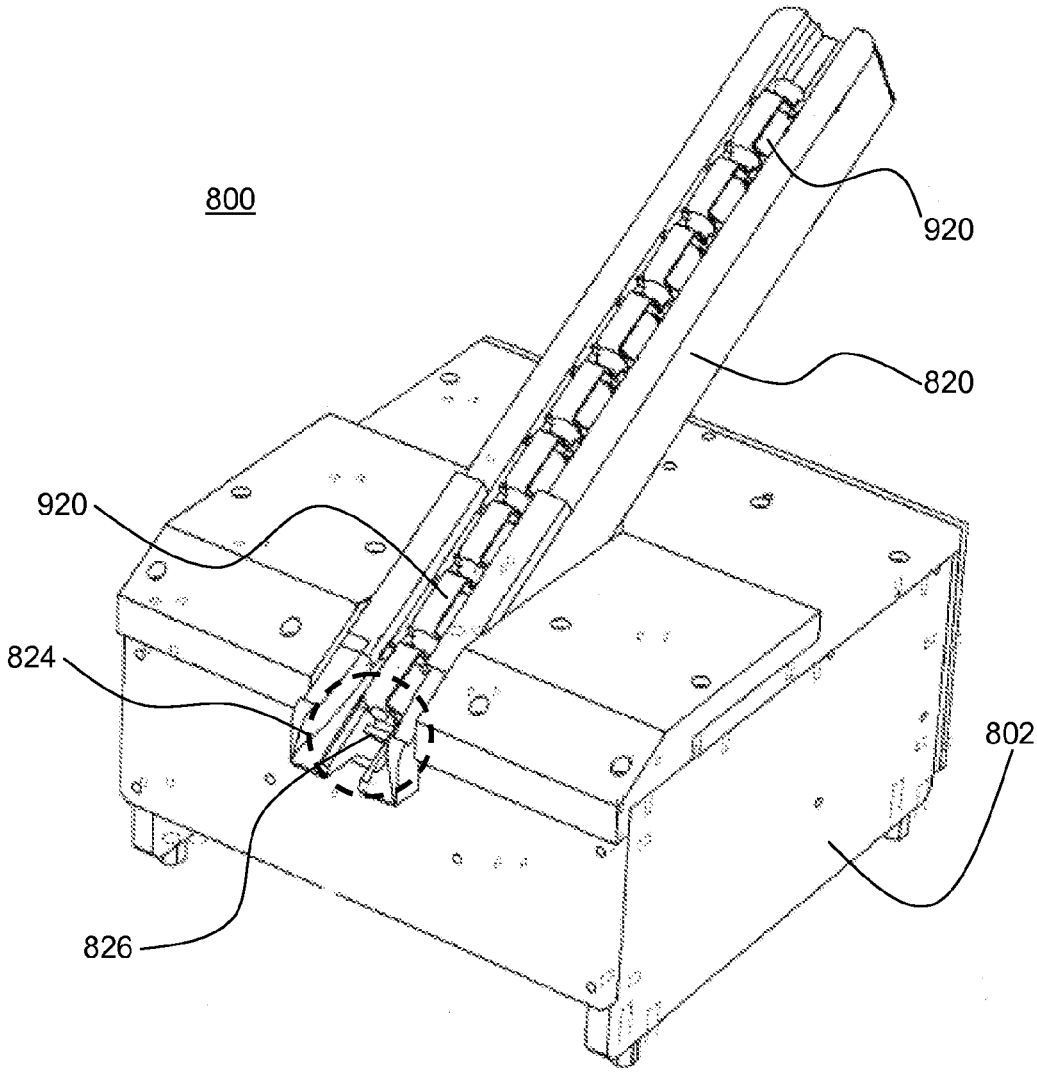
FIG. 7A is a top perspective view of a device for crimping an insulation displacement connector in accordance with one aspect of the present invention.
Figure 7B:
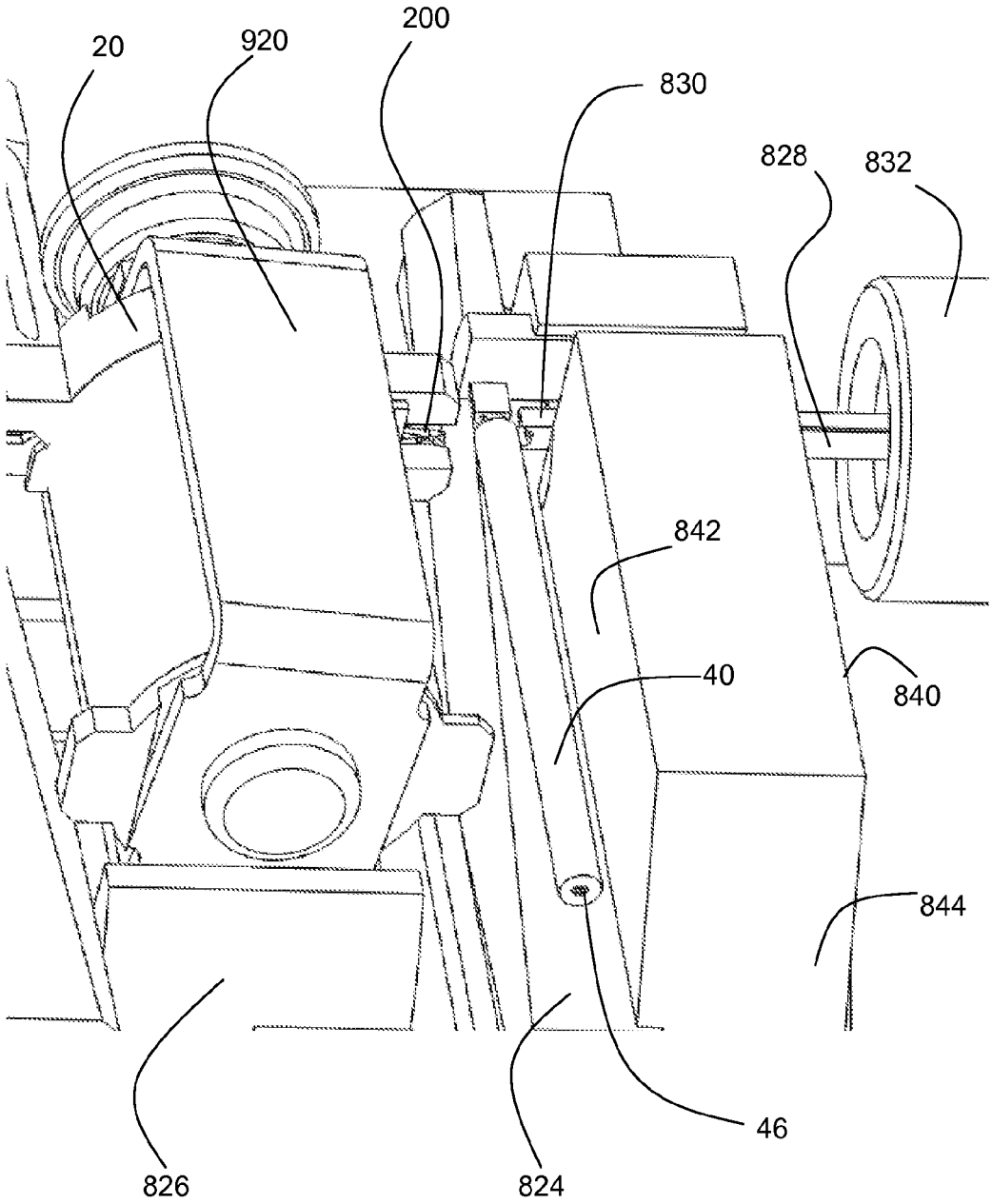
FIG. 7B is an exposed detailed view of the work station of the device of FIG. 7A in accordance with one aspect of the present invention.
Figure 7C:
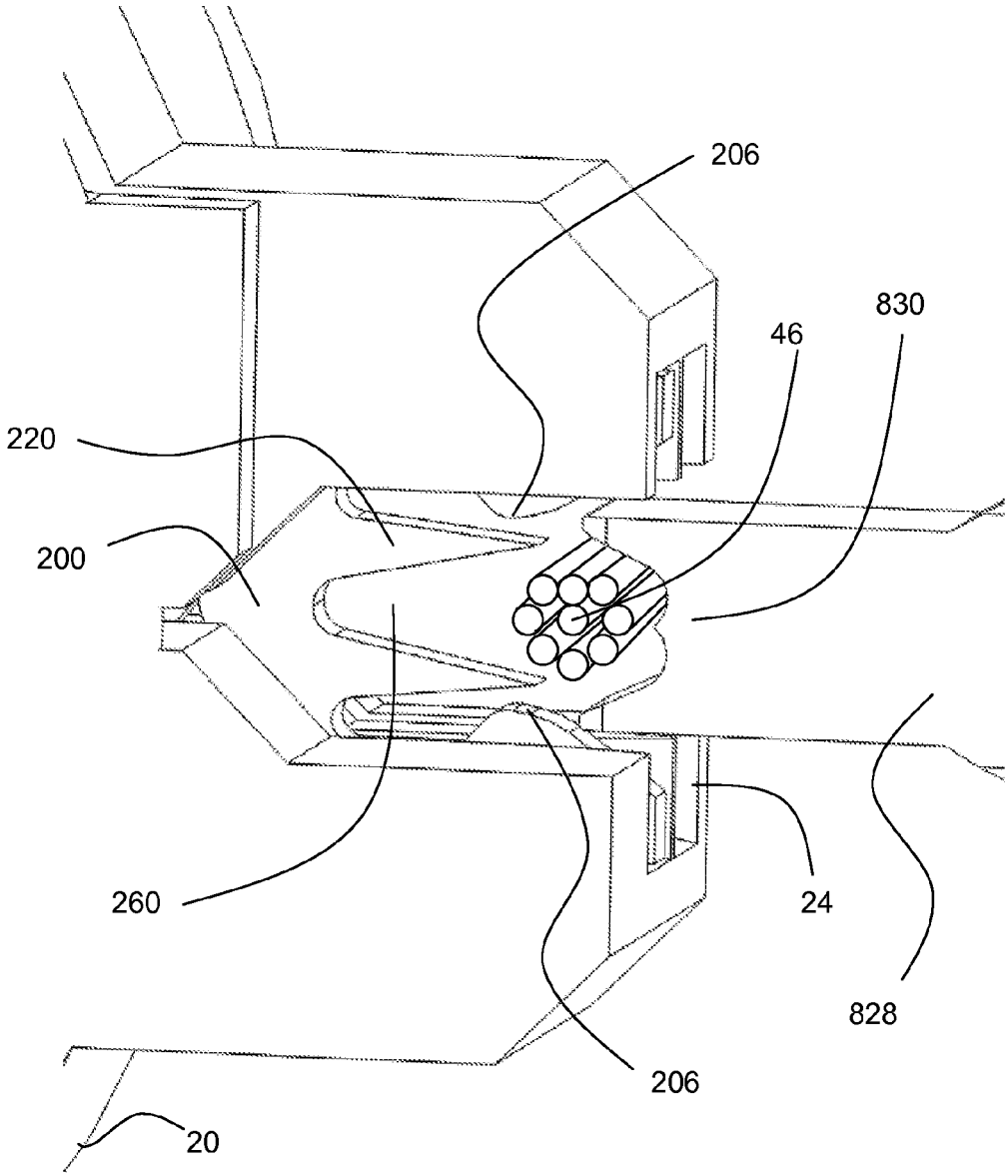
FIG. 7C is a close-up view of the crimping tool and work-piece of the device of FIG. 7A.

An exposed detailed view of the orientation of the crimping tool 828 to the work station 824 containing a wire 40, work-piece 920 and connector 200 is depicted in FIG. 7B. The portion of the wire 40 which has been stripped of the insulation 44 so that the conductor wire 46 is exposed is positioned on the work station 824 so that as the crimping tool 828 moves toward the connector 200, the conductor wire 46 is pushed into the receiving pocket 260 of connector 200 by the crimping tool 828 and enclosed by the deformable tangs 220 (a close-up view is shown in FIG. 7C). The crimping tool 828 includes a terminal end 830 that makes contact with the tangs 220 and curls the tangs around the conductor wire 46 that is situated proximate to the receiving pocket 260. As the deformable tangs 220 are curled the ends of each of the deformable tangs 220 come into contact with one another to enclose the conductor wire 46. The terminal end 830 is preferably sized and shaped to create the specific curled shape of the tangs 220. The crimping tool 828 may further include a spring-loaded sheath 832. The sheath 832 moves in the same direction but independently from the crimping tool 828. At a pre-determined point, the spring-loaded sheath 832 stops moving while the crimping tool 828 continues to move towards the connector 200. The opposite end of the crimping tool 828 is attached to a cam shaft as discussed below.

Although not shown, two crimping tools 828 may be attached to the same cam shaft and thereby move simultaneously.

The device 800 may also include a lead wire guide 840 which functions to aid the operator in positioning the lead wire 40 over the receiving pocket 260 so that the crimping tool 828 can push the lead wire 40 into the receiving pocket 260. The lead wire guide 840 includes walls 842 and 844 that guide the wire into position and reduces the chance of wire slippage from operator error and/or as the crimping tool 828 is in motion.

Figure 7D:
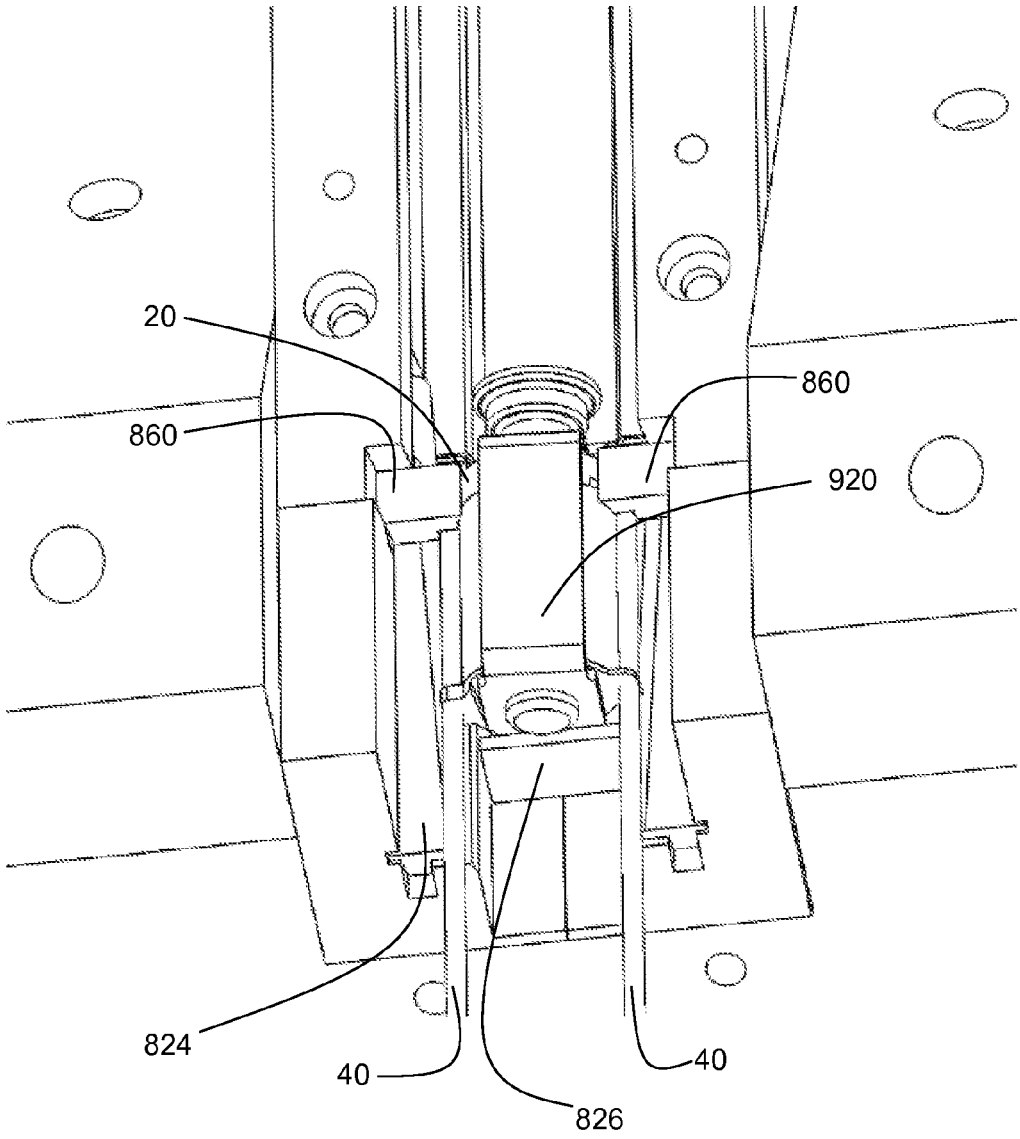
FIG. 7D is an exposed detailed view of the work station of the device of FIG. 7A in accordance with one aspect of the present invention.

Now referring to FIG. 7D, the crimping tool 828 may further include work-piece holders 860. Although not shown, the work-piece holders 860 may be connected to the spring-loaded sheath 832 and function to hold the work-piece 920 in place as the crimping tool (not shown) exerts force on the connector 200 and results in the accurate curling of the deformable tangs 220. In FIG. 7D, there are depicted two lead wires 40, which as will be apparent to the skilled artisan, can be secured to two connectors in a single solenoid via two crimping tools 828 attached to a single cam shaft. The work-piece holder 860 may be adapted to various sized and shaped work-pieces 920. For example, the work-piece holders 860 are adapted to enclose the bobbin 20 and connector slots 24. The work-piece holders 860 and spring-loaded sheath 832 move with the crimping tool 828 towards the work-piece 920 until the work-piece holders 860 contact the work-piece 920 and thereby stops and holds the work-piece 920 in place as the crimping tool 828 continues to curl the deformable tangs 220.

Figure 7E:
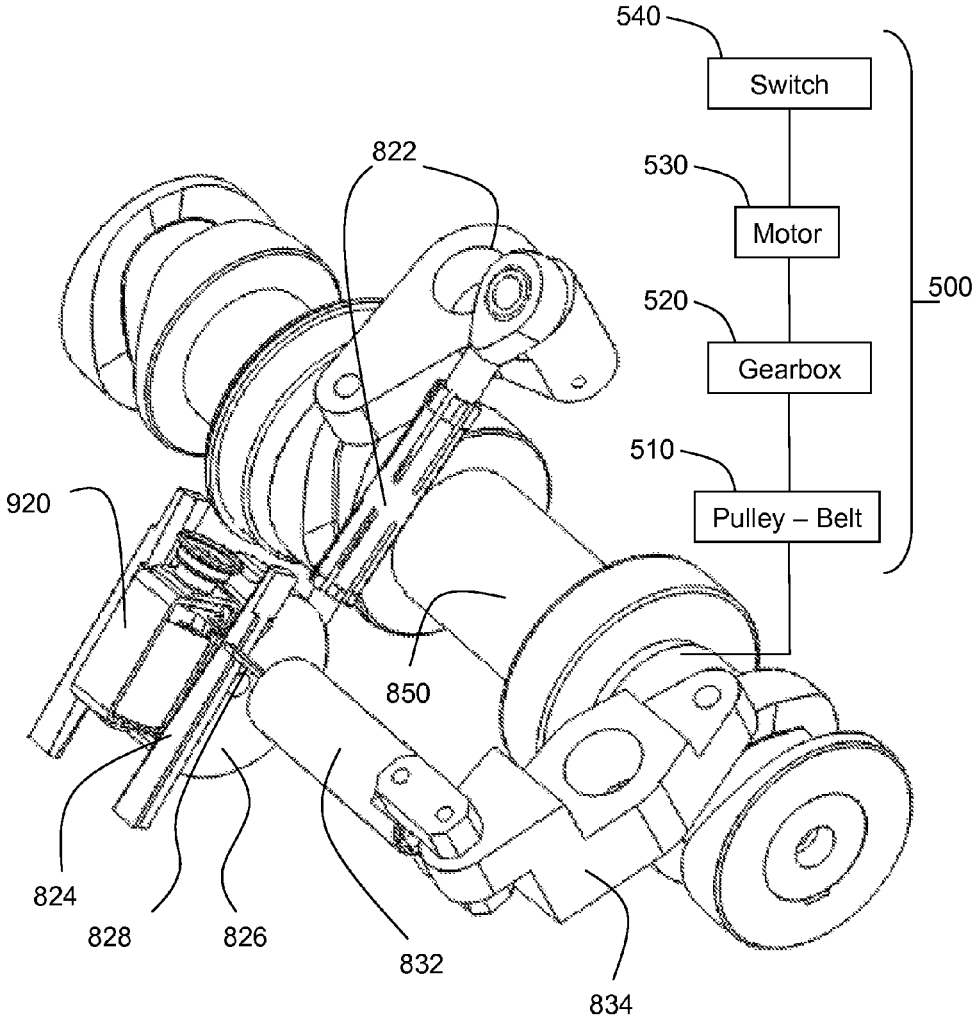
FIG. 7E is a perspective view of the crimping tool and motorized mechanism of the device of FIG. 7A.
Figure 7F:
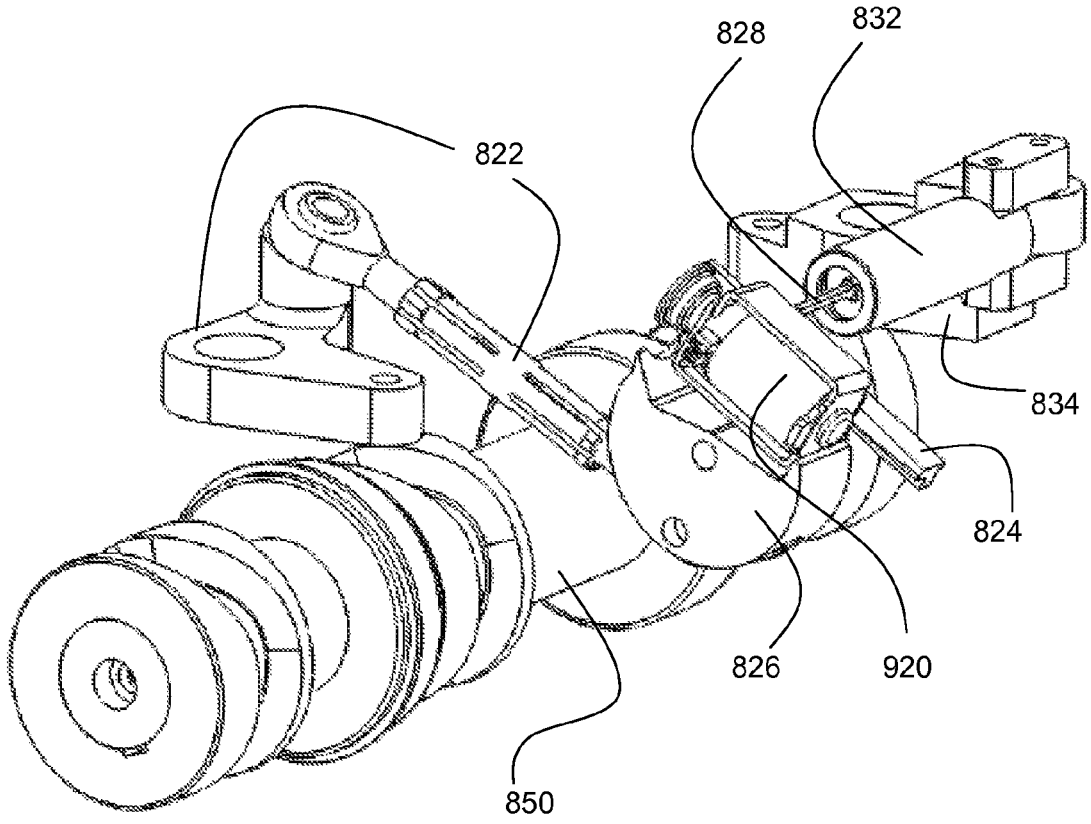
FIG. 7F is a perspective view of the crimping tool and motorized mechanism of the device of FIG. 7A.

FIGS. 7E-7F show an embodiment of an orientation of the crimping tool 828 connected to a cam shaft 850, work station 824 and work-piece 920. The crimping tool 828 is adjacent to a connector on the work-piece 920. Although not shown, a second crimping tool 828 may be oriented opposite to the one shown, and adjacent to a second connector. For example, with a bobbin 20 where the two connector pockets 24 and connectors 200 are placed opposite to one another (as shown in FIG. 2H), the crimping tools 828 are also positioned opposite to one another. The crimping tool 828 and spring-loaded sheath 832 are connected to the cam shaft 850 by a bracket arm 834 shaped and sized to fit the housing 802, as is known to the skilled artisan. Movement of the crimping tools 828 and spring-loaded sheath 832 is controlled by the cam shaft 850 which is preferably motor driven.

The device 800 may also include an escapement mechanism 822 connected to the stop guide rocker 826 which functions to release and eject a finished work-piece 920 from the work station 824. The finished work-piece 920 is a work-piece 920 wherein the one or more wires have been connected via the curling of the deformable tangs 220. The escapement mechanism 822 is applied according to methods known to the skilled artisan, for example an escapement used in a mechanical clock. The escapement mechanism 822 is connected to the cam shaft 850. As the cam shaft 850 moves the escapement mechanism 822, the stop guide rocker 826 rotates and pushes and/or releases the finished work-piece 920 away from the work station 824. When the escapement mechanism 822 is combined with the slide 820 (FIG. 7A), once the finished work-piece 920 has been ejected, gravitational force moves the next work-piece 920 down the slide 820 and into the stop guide rocker 826.

The motorized mechanism 500 may include a motor 530 such as a servomotor, a gearbox 520, one or more belts and/or pulleys 510, a switch 540, and other parts well-known in the art. For example, a servomotor such as the Mitsubishi brushless servomotor model No. HC-MFS23K, a gearbox such as the Apex Dynamics model No. AB90-050, and a controller such as the Mitsubishi MR-J2S-20CL1 may be used in combination to drive the cam shaft 850. As shown in FIG. 7E, the cam shaft 850 is connected to pulleys/belts 510, gearbox 520 and motor 530. The motorized mechanism 500 functions to drive the device 800 through a prescribed machine cycle to attach one or more wires to the work piece 920. The switch 540 that functions to initiate the machine cycle is connected to the motor 530. One skilled in the art will recognize that the device 800 can be operated manually without a motorized mechanism, such as by a crank connected to a cam shaft. In addition, a motorized mechanism external to the housing can be connected to drive the cam shaft.

To use the device 800, a work-piece 920 is positioned in the stop guide rocker 826 such that the connectors 200 are aligned with one or more crimping tool 828. In one embodiment a portion of the lead wire 40 is stripped of insulation 44 to expose the conductor wire 46 where contact is made with the deformable tangs 220 of the connector 200. The stripped portion of the lead wires 40 may be positioned by an operator in proximity to the receiving pocket 260 of the connector 200. In one embodiment, the work station 824 having wire guides 840 help position the conductor wire 46 proximate to the receiving pocket 260 of connector 200. An operator may activate a switch 540 to initiate a machine cycle. A motor 530 turns the cam shaft 850 which actuates the crimping tools 828, and optionally the work-piece guides 860 and spring-loaded sheaths 832, to push the conductor wire 46 into the corresponding receiving pocket 260. As each of the crimping tools 828 approach and impinge the corresponding connector 200, contact is made with the deformable tangs 220 causing the deformable tangs 220 to curl under the force exerted on them by the crimping tool 828. The crimping tools 828 also exert force against one another and function to further force the connectors 200 into the connector slot 24. Contact of the crimping tool 828 is also made with the protrusions 206 as the connectors 200 are forced into the connector slot 24, causing the posts 202 become deformed and expand outwards (see FIGS. 8A-8D). At the same time one or more of the protrusions 280 and wedges 290 may be forced into the connector slot 24 and create a tight and snug orientation. This movement of the connector 200 may further aid in making a stronger contact with the magnet wire 30.

In another embodiment an operator may manually force the crimping tools 828 onto the connector 200 to crimp the tangs 220 around the conductor wire 46 and create a secure connection.

Figure 8A:
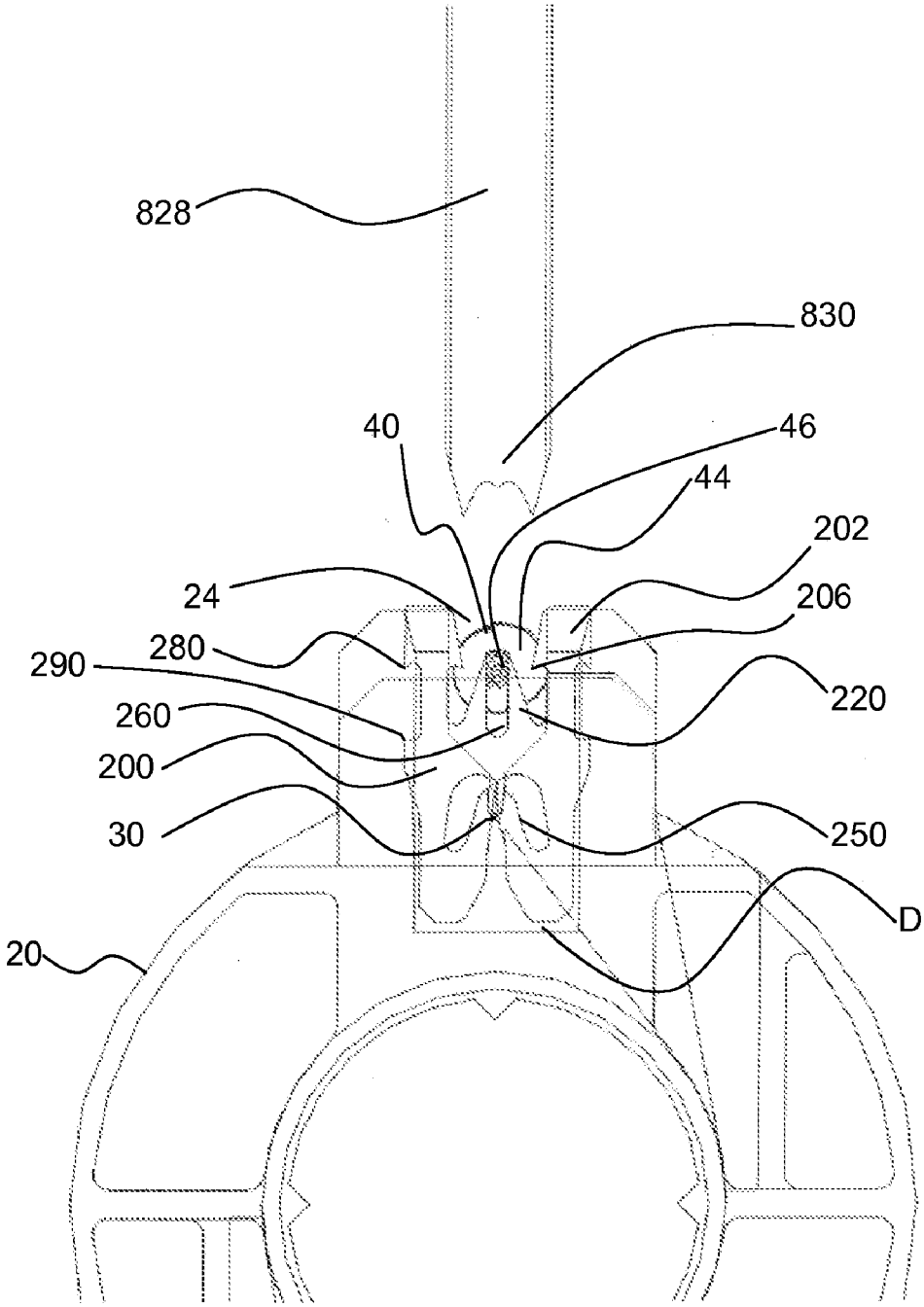
FIG. 8A is a front view of a solenoid assembly, in alignment with the crimping/curling tool of the device of FIG. 7A, prior to the crimping/curling cycle in accordance with one aspect of the present invention.

FIGS. 8A-8D depict the curling of the tangs 220 of connector 200 in bobbin 20 by the crimping tool 828. Only one connector 200 and crimping tool 828 is shown, however, if present, an opposing second connector 200 disposed on the bobbin 20 may be simultaneously curled by a second crimping tool 828 (see the bobbin of FIG. 2H). FIG. 8A is a detailed view of the positioning of one lead wire 40 in relation to one crimping tool 828 is shown. The connector 200 is positioned in the connector slot 24 of the bobbin 20 such that a distance D exists between the connector 200 and the bottom of the connector slot 24. An operator positions the lead wire 40 so that the exposed conductor wire 46 is situated proximate to the receiving pocket 260.

Figure 8B:
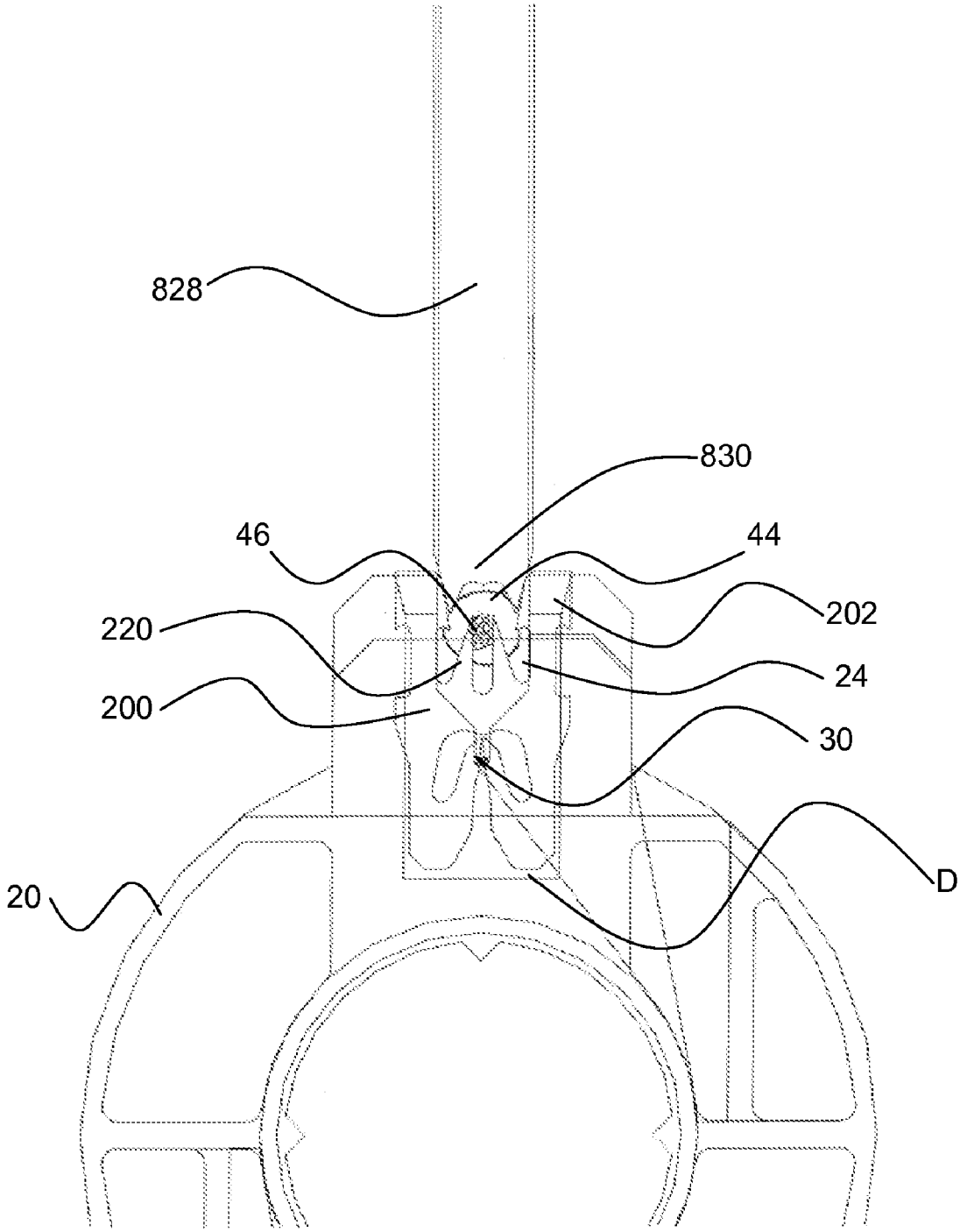
FIG. 8B is a front view of a solenoid assembly, in alignment with the crimping/curling tool of the device of FIG. 7A, after the initiation of the crimping/curling cycle in accordance with one aspect of the present invention.
Figure 8C:
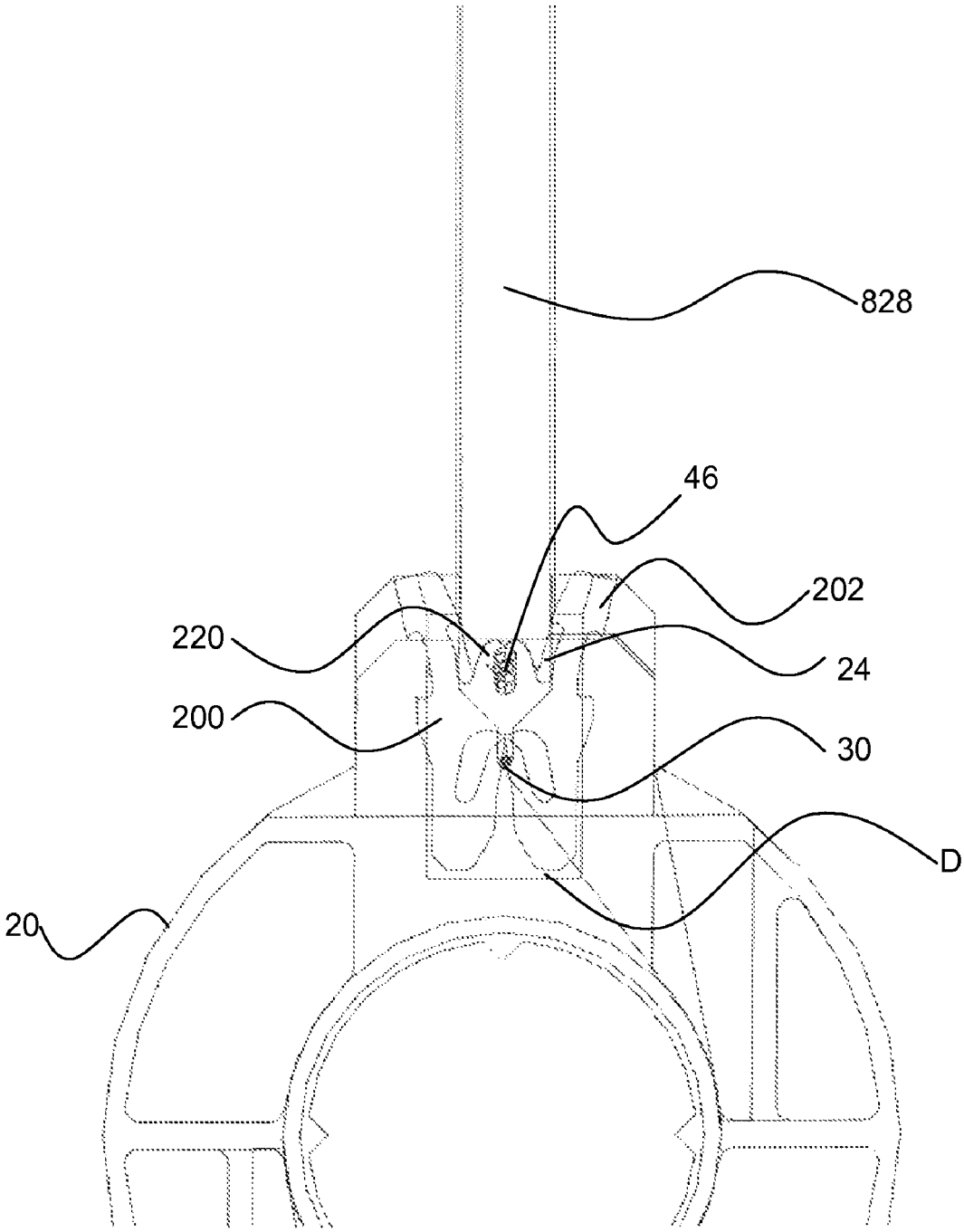
FIG. 8C is a front view of a solenoid assembly, in alignment with the crimping/curling tool of the device of FIG. 7A, during the crimping/curling cycle in accordance with one aspect of the present invention.
Figure 8D:
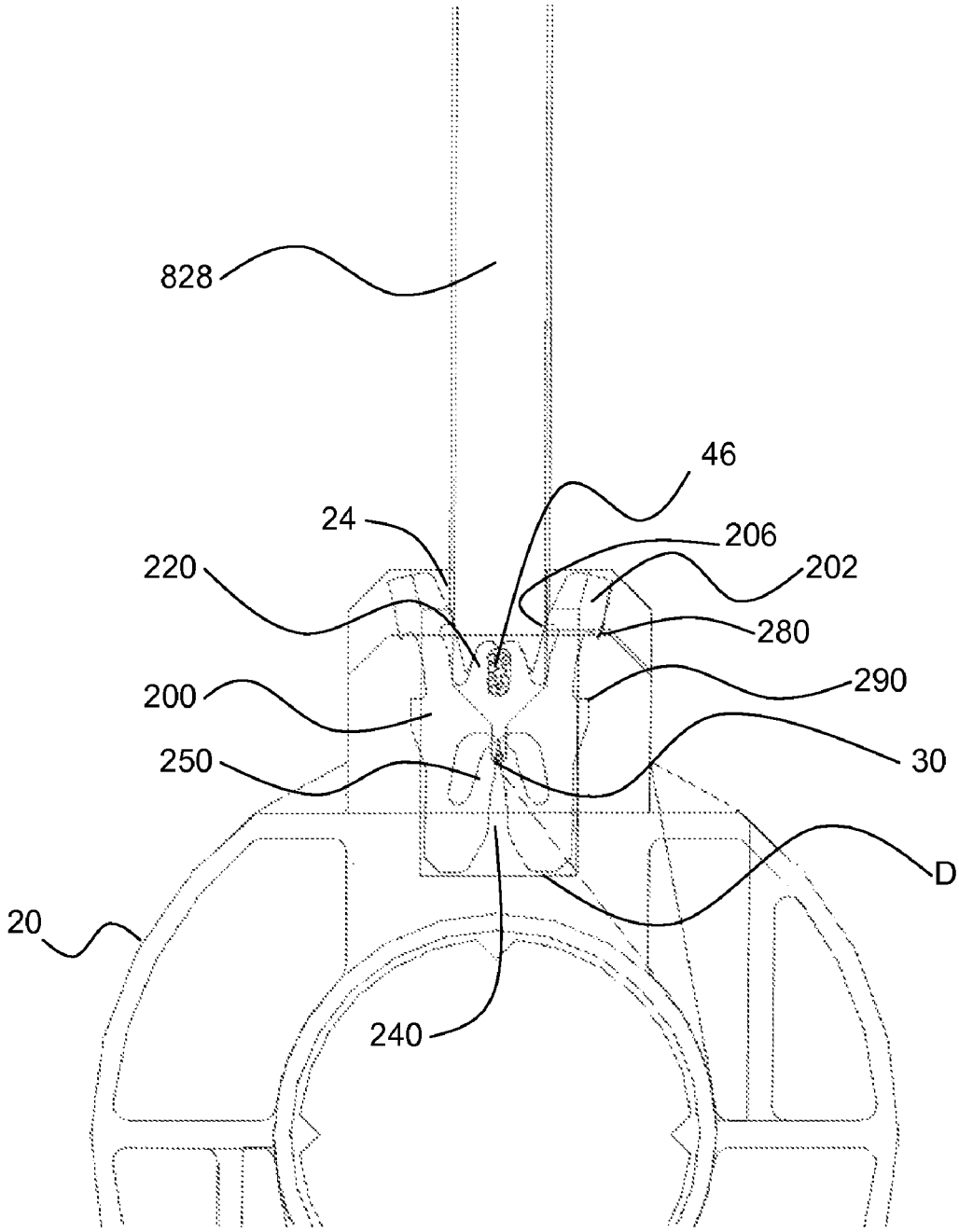
FIG. 8D is a front view of a solenoid assembly, in alignment with the crimping/curling tool of the device of FIG. 7A, on completion of the crimping/curling cycle in accordance with one aspect of the present invention.

Now referring to FIG. 8B, as the crimping tool 828 is moved by cam shaft 850 towards the connector 200, the crimping tool 828 pushes the conductor wire 46 further into the receiving pocket 260. FIG. 8C depicts the crimping tool 828 continuing to move towards the connector 200 and impinges and curls the tangs 220 around the conductor wire 46. As shown in FIG. 8D, as the crimping tool 828 continues to move the connector 200, it forces the connector 200 further into the connector slot 24 (slightly reducing distance D, however, not so much as to result in the ends 299 coming into contact with the bottom of the connector slot 24), the connection of the magnet wire 30 may be enhanced by forcing the magnet wire 30 further into slot 240 and between blades 250, and the posts 202 are deformed such that the posts 202, protrusions 280 and/or wedges 290 are further forced in the connector slot 24 creating a tight and snug fit.

Figure 8E:
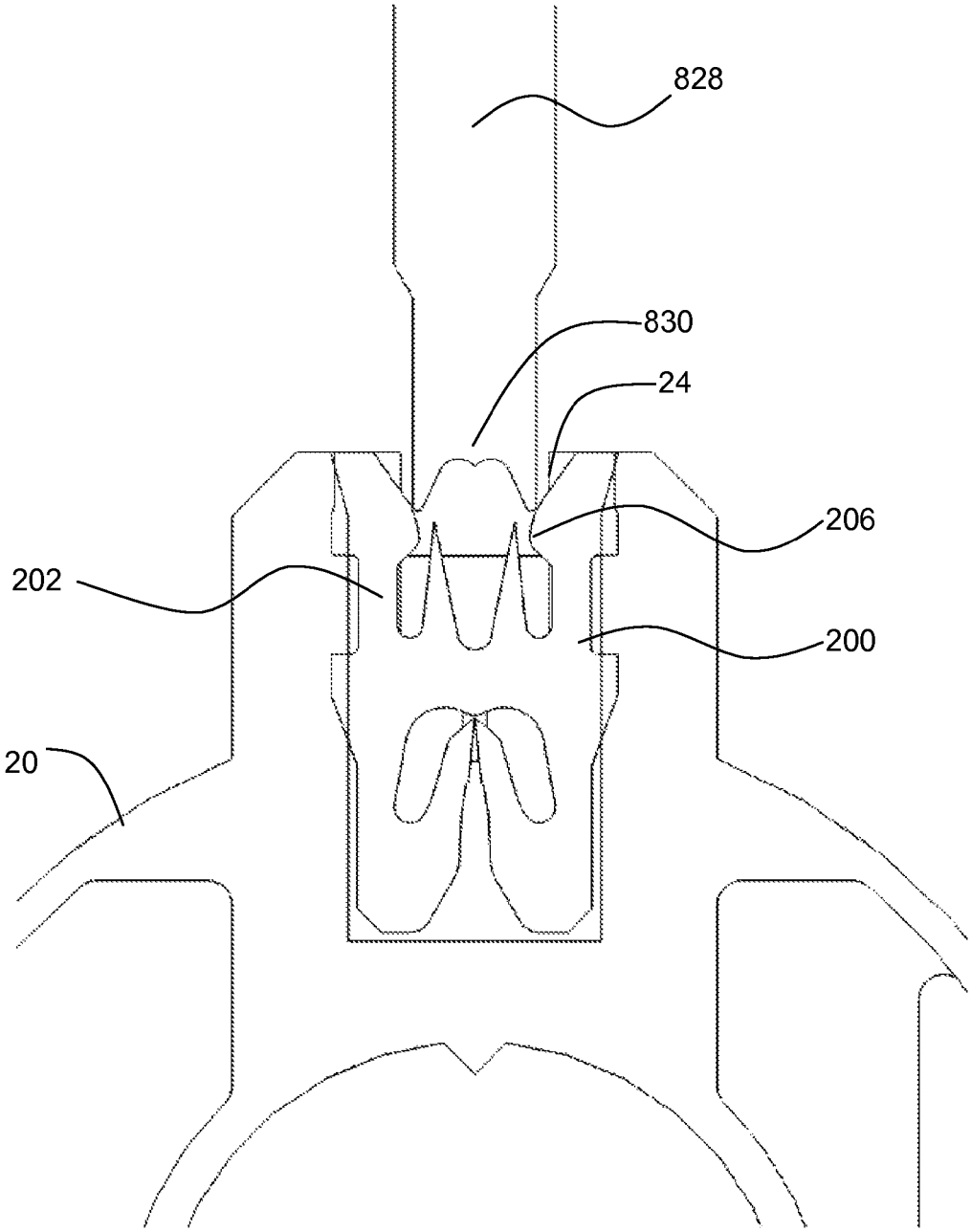
FIG. 8E is a front view of a solenoid assembly employing a connector of FIG. 2D, in alignment with the crimping/curling tool of the device of FIG. 7A, after the initiation of the crimping/curling cycle in accordance with one aspect of the present invention.

Now referring to FIG. 8E, the connector 200 employed in this embodiment includes the protrusions 206 (as depicted in FIGS. 2C-2D) that are sized and shaped to communicate with the crimping tool 828 as the crimping tool 828 moves towards the connector 200. As the crimping tool 828 impinges on the tangs 200, the terminal end 830 also impinges on the protrusions 206 and expands and forces apart the posts 202 so that the posts 202 penetrate further into the connector slot 24. This expansion of the posts 202 create additional frictional force towards the connector 200 that aids in the curling of the tangs 220. As the posts 202 are expanded, such expansion further secures the connection between the wires, connector 200 and bobbin 20.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An insulation displacement connector comprising:

a substantially planar body having a first end and a second end opposite the first end, at least two deformable tangs extending from the first end of the planar body, each tang having an outer wall and an inner wall, wherein the inner walls form a receiving pocket in axial alignment with the planar body;

at least one post extending from the planar body substantially parallel to the deformable tangs, wherein the at least one post comprises at least one inner wall comprising a protrusion extending from the post toward the tangs, and/or at least one outward facing wall comprising a protrusion extending away from the tangs;

the receiving pocket adapted to receive and conductively engage a first wire, and wherein each deformable tang is dimensioned to curl around the first wire; and a fastener extending from the first or second end of the planar body and in axial alignment with the planar body, the fastener adapted to conductively engage a second wire.

2. An insulation displacement connector according to claim 1 whereby engagement of the first wire with the receiving pocket and engagement of the second wire with the fastener establishes electrical contact between the wires through the planar body.

3. An insulation displacement connector according to claim 1, wherein at least one inner wall has a length equal to or greater than a length of the outer wall.

4. An insulation displacement connector according to claim 1, further comprising at least one detent formed in a peripheral edge thereof.

5. An insulation displacement connector according to claim 1, wherein the fastener comprises an elongated post extending away from the planar body and in axial alignment therewith.

6. An insulation displacement connector according to claim 5, wherein the fastener extends from the first end of the body.

7. An insulation displacement connector according to claim 5, wherein the fastener comprising the elongated post comprises a bendable region permitting the post to be bent toward the body of the connector.

8. An insulation displacement connector according to claim 1, said connector further comprising at least two lateral edges.

9. An insulation displacement connector according to claim 8, at least one lateral edge further comprising a wedge located between the two ends.

10. An insulation displacement connector according to claim 9, at least one wedge located substantially about a centerline between the two ends.

11. An insulation displacement connector according to claim 1, wherein the fastener extends from the second end of the planar body in axial alignment therewith, the fastener comprising opposing blades forming a slot, with ends protruding from an open end of the slot toward a closed end of the slot, and at least one of the opposing blades comprising an opposing blade lateral edge.

12. An insulation displacement connector according to claim 11, wherein one of the opposing blades comprises an extended body portion with a body edge.

13. An insulation displacement connector comprising:

a substantially planar body having a first end and a second end opposite the first end, at least two deformable tangs extending from the first end of the planar body, each tang having an outer wall and an inner wall, wherein the inner walls form a receiving pocket in axial alignment with the planar body;

the receiving pocket adapted to receive and conductively engage a first wire, and wherein each deformable tang is dimensioned to curl around the first wire; and a fastener extending from the first or second end of the planar body and in axial alignment with the planar body, the fastener adapted to conductively engage a second wire, wherein the fastener extends from the second end of the planar body in axial alignment therewith, the fastener comprising opposing blades forming a slot, with ends protruding from an open end of the slot toward a closed end of the slot, and at least one of the opposing blades comprising an opposing blade lateral edge.

14. An insulation displacement connector according to claim 13, wherein one of the opposing blades comprises an extended body portion with a body edge.

15. An insulation displacement connector comprising:

a substantially planar body having a first end and a second end opposite the first end, at least two deformable tangs extending from the first end of the planar body, each tang having an outer wall and an inner wall, wherein the inner walls form a receiving pocket in axial alignment with the planar body;

the receiving pocket adapted to receive and conductively engage a first wire, and wherein each deformable tang is dimensioned to curl around the first wire; and a fastener extending from the first or second end of the planar body and in axial alignment with the planar body, the fastener adapted to conductively engage a second wire, wherein the fastener extends from the first end of the body and comprises an elongated post extending away from the planar body and in axial alignment therewith.

16. An insulation displacement connector according to claim 15, wherein the fastener comprising the elongated post comprises a bendable region permitting the post to be bent toward the body of the connector.

* * * * *